US010130150B2

(12) United States Patent
Barenbrug et al.

(10) Patent No.: US 10,130,150 B2
(45) Date of Patent: Nov. 20, 2018

(54) LUGGAGE ASSEMBLY AND A FRAME

(71) Applicant: ROYALTY BUGABOO GMBH, Zug (CH)

(72) Inventors: Machiel Gerardus Theodorus Marie Barenbrug, Amsterdam (NL); Erik Geert Spoek, Voorburg (NL); Jacob Geert Arie Den Boer, Amersfoort (NL); Marc Constantijn Van Zijl, Hilversum (NL)

(73) Assignee: ROYALTY BUGABOO GMBH, Zug (CH)

( * ) Notice: Subject to any disclaimer, the term of this patent is extended or adjusted under 35 U.S.C. 154(b) by 181 days.

(21) Appl. No.: 15/023,860

(22) PCT Filed: Sep. 23, 2014

(86) PCT No.: PCT/EP2014/070169
§ 371 (c)(1),
(2) Date: Mar. 22, 2016

(87) PCT Pub. No.: WO2015/049121
PCT Pub. Date: Apr. 9, 2015

(65) Prior Publication Data

US 2016/0235171 A1 Aug. 18, 2016

(30) Foreign Application Priority Data

Oct. 3, 2013 (WO) ..... PCT/EP2013/070625

(51) Int. Cl.
*B62B 1/00* (2006.01)
*A45C 5/14* (2006.01)
(Continued)

(52) U.S. Cl.
CPC ..... *A45C 5/146* (2013.01); *A45C 5/03* (2013.01); *A45C 13/04* (2013.01); *A45C 13/262* (2013.01); *A45C 2005/148* (2013.01)

(58) Field of Classification Search
CPC .. A45C 5/00; A45C 5/03; A45C 5/146; A45C 5/14; A45C 5/141; A45C 5/143;
(Continued)

(56) References Cited

U.S. PATENT DOCUMENTS 384,295 A 6/1888 Stockwell
480,710 A 8/1889 Harding
(Continued)

FOREIGN PATENT DOCUMENTS

AU 2016767 A 10/1969
CA 1151116 A 8/1983
(Continued)

OTHER PUBLICATIONS

International Search Report and Written Opinion issued in International Application No. PCT/EP2014/070169.

*Primary Examiner* — James M Dolak
(74) *Attorney, Agent, or Firm* — Kenealy Vaidya LLP

(57) ABSTRACT

Some embodiments are directed to a luggage assembly, and frame, wherein the luggage assembly includes a luggage item and a wheel assembly. The wheel assembly includes at least one front wheel, and rear wheels which are all moveable between a folded and an unfolded position. The folded positions of the wheels are within the luggage assembly. The unfolded position of the rear wheels is behind the luggage assembly and the unfolded position of the front wheel is below the luggage assembly. When the wheels are in the unfolded position and the luggage assembly is arranged on the wheels on the ground, the luggage item is tilted and a projected point of gravity of the luggage item is in between
(Continued)

the wheels. The disclosed luggage assembly is suitable for being pushed and being pulled, is very stable and provides a stable road behavior.

13 Claims, 7 Drawing Sheets

(51) Int. Cl.
*A45C 5/03* (2006.01)
*A45C 13/04* (2006.01)
*A45C 13/26* (2006.01)

(58) Field of Classification Search
CPC ..... A45C 5/145; A45C 13/04; A45C 13/262; A45C 13/38; A45C 13/385; A45C 2005/148; B62B 2202/24; B62B 2301/00; B62B 2301/05; B62B 5/0083; B62B 5/0086; B62B 3/00; B62B 3/02
See application file for complete search history.

(56) References Cited

U.S. PATENT DOCUMENTS 431,462 A 7/1890 Herndon
512,766 A 1/1894 Tubach
534,832 A 2/1895 Jenings et al.
1,409,838 A 3/1922 Emery et al.
1,895,677 A 1/1933 Pinheiro
2,581,417 A * 1/1952 Jones ..... A45C 5/146 16/34
2,602,675 A 7/1952 Forman
3,178,197 A 4/1965 Boatner
3,352,568 A * 11/1967 Ahlf ..... A45C 5/146 280/35
3,659,867 A 5/1972 Curry
3,842,953 A 10/1974 Royet
4,087,102 A 5/1978 Sprague
4,314,624 A 2/1982 Royet
4,335,895 A 6/1982 Walker
4,575,109 A 3/1986 Cowdery
4,588,055 A 5/1986 Chen
4,647,056 A * 3/1987 Baker ..... A45C 13/385 190/18 A
4,917,392 A 4/1990 Ambasz
4,953,257 A 9/1990 Seynhaeve
4,969,660 A 11/1990 Spak
5,072,958 A 12/1991 Young
5,154,265 A * 10/1992 Capistrant ..... A45C 5/146 16/34
5,263,727 A 11/1993 Libit et al.
5,403,023 A * 4/1995 Tsai ..... A45C 13/385 280/42
5,533,231 A 7/1996 Bai
5,630,601 A 5/1997 vom Braucke et al.
5,749,503 A 5/1998 Wulf
5,758,752 A * 6/1998 King ..... A45C 3/004 16/19
5,803,471 A 9/1998 DeMars et al.
5,873,145 A 2/1999 Chou
5,984,154 A 11/1999 Scicluna
5,984,327 A 11/1999 Hsieh et al.
6,016,893 A 1/2000 Chen
6,042,127 A 3/2000 Rupolo
6,047,442 A 4/2000 Workman
6,141,841 A 11/2000 Workman
6,179,176 B1 1/2001 Saggese
6,182,981 B1 2/2001 Kuo
6,186,295 B1 2/2001 Lin
6,196,366 B1 3/2001 Lin
6,196,560 B1 3/2001 Ohisson
6,213,266 B1 4/2001 Hollingsworth
6,213,267 B1 4/2001 Miller
6,237,734 B1 5/2001 Chen
6,260,871 B1 7/2001 Liu
6,279,705 B1 8/2001 Wu
6,289,554 B1 9/2001 Wang
6,305,587 B1 10/2001 Miller
6,360,400 B1 3/2002 Chang
6,367,602 B1 4/2002 Chang
6,401,888 B1 6/2002 Kuo
6,401,890 B1 6/2002 Tan
6,409,412 B1 6/2002 Huang
6,454,065 B1 9/2002 Chen
6,471,019 B1 10/2002 Miller
6,474,524 B1 11/2002 Ivarson
6,484,362 B1 11/2002 Kuo
6,530,507 B2 3/2003 Oh
6,533,086 B1 3/2003 Waddell
6,575,493 B1 6/2003 Lowenstein
6,591,950 B1 7/2003 Scicluna
6,604,617 B2 8/2003 Davis
6,609,271 B2 8/2003 Kuo
6,612,411 B2 * 9/2003 Nykoluk ..... A45C 5/146 190/115
6,736,073 B2 5/2004 Ryburg
6,769,701 B1 8/2004 Clausen
6,832,670 B2 12/2004 Wolters
6,880,685 B2 4/2005 Fenton
6,923,352 B2 8/2005 Oh
6,961,976 B2 11/2005 Kuo
6,964,420 B1 11/2005 Ghanizadeh
7,051,853 B2 * 5/2006 Brown ..... A45C 5/14 190/1
7,066,311 B2 6/2006 O'Shea
7,070,190 B2 7/2006 Sadow
7,073,694 B2 7/2006 King
7,093,700 B2 8/2006 Krulik
7,097,181 B2 8/2006 Sadow
7,097,183 B1 8/2006 Su
7,143,912 B2 12/2006 Caneba
7,226,073 B1 6/2007 Zahiri
7,232,018 B1 6/2007 Salander
7,237,660 B2 7/2007 Wu
7,281,616 B2 10/2007 Peterson
7,284,304 B2 10/2007 Fenton
7,318,507 B2 1/2008 Fenton
7,328,779 B2 2/2008 King
7,374,183 B1 5/2008 Yen-Lung
7,426,985 B2 9/2008 Krulik
7,441,785 B1 10/2008 Tsai
7,478,803 B2 1/2009 Lee
7,500,680 B2 * 3/2009 Dayton ..... A45C 5/146 280/19.1
7,594,569 B2 9/2009 Bass
7,597,341 B2 10/2009 Russo
8,286,767 B2 * 10/2012 Malinowski ..... A45C 5/14 190/115
8,757,643 B2 * 6/2014 Arthur ..... A45C 5/146 16/34
9,375,063 B2 * 6/2016 Chen ..... A45C 7/0054
9,433,270 B2 * 9/2016 D'Angelo ..... A45C 5/146
9,681,717 B2 * 6/2017 Meersschaert ..... A45C 7/0018
9,999,284 B1 * 6/2018 Tan ..... A45C 7/0036
2001/0040080 A1 11/2001 Kuo
2002/0130005 A1 9/2002 Schwartz
2002/0185350 A1 12/2002 Chang
2003/0034215 A1 2/2003 Lin
2003/0034636 A1 2/2003 Ng
2004/0000457 A1 1/2004 Sanford-Schwentke
2004/0004332 A1 1/2004 Tsai
2004/0026199 A1 2/2004 Chen
2004/0074725 A1 4/2004 Shih
2004/0163910 A1 8/2004 Lee
2004/0211634 A1 10/2004 Chan
2004/0226135 A1 * 11/2004 Wang ..... B60B 33/0007 16/44
2004/0238303 A1 12/2004 Hafif
2005/0077133 A1 4/2005 Cassegrain
2005/0077706 A1 4/2005 O'Shea
2005/0098402 A1 5/2005 Cohen
2005/0103590 A1 5/2005 Hu
2005/0150733 A1 7/2005 Chen

(56) References Cited

U.S. PATENT DOCUMENTS

| | | | |
|---|---|---|---|
| 2005/0258621 | A1 | 11/2005 | Johnson et al. |
| 2005/0285359 | A1 | 12/2005 | Wang |
| 2006/0010644 | A1 | 1/2006 | Foster |
| 2006/0086583 | A1 | 4/2006 | Hoberman |
| 2006/0102677 | A1 | 5/2006 | Nassanian |
| 2006/0175170 | A1 | 8/2006 | Brown |
| 2006/0196743 | A1 | 9/2006 | Lin |
| 2006/0207848 | A1 | 9/2006 | Sher |
| 2008/0000742 | A1 | 1/2008 | Lee et al. |
| 2008/0236972 | A1 | 1/2008 | Lee |
| 2008/0136133 | A1 | 6/2008 | Takahashi |
| 2008/0223679 | A1 | 9/2008 | Wong |
| 2008/0277220 | A1 | 11/2008 | Hoang et al. |
| 2008/0308370 | A1 | 12/2008 | Chung et al. |
| 2009/0057082 | A1 | 3/2009 | Mize |
| 2009/0139813 | A1 | 6/2009 | Francis |
| 2009/0160147 | A1 | 6/2009 | Arthur |
| 2009/0188764 | A1 | 7/2009 | Miyoshi |
| 2009/0218187 | A1 | 9/2009 | Chung |
| 2010/0000805 | A1 | 1/2010 | Pan |
| 2010/0025174 | A1 | 2/2010 | Dayton |
| 2010/0095480 | A1 | 4/2010 | Scicluna |
| 2010/0108452 | A1 | 5/2010 | Williams |
| 2010/0263977 | A1 | 10/2010 | Wu |
| 2010/0307879 | A1 | 12/2010 | Saetia |
| 2010/0308563 | A1 | 12/2010 | Martin |
| 2011/0247910 | A1 | 10/2011 | Darvish |
| 2012/0160617 | A1 | 6/2012 | Qi et al. |
| 2012/0261223 | A1 | 10/2012 | Pattni |
| 2015/0091264 | A1 | 4/2015 | Herbault et al. |
| 2016/0045000 | A1 | 2/2016 | Green |

FOREIGN PATENT DOCUMENTS

| | | | |
|---|---|---|---|
| CA | 2422913 | A1 | 9/2004 |
| CA | 2547225 | A1 | 11/2006 |
| CA | 2663373 | A1 | 10/2009 |
| CA | 2948454 | A1 | 11/2015 |
| CH | 468803 | A | 2/1969 |
| CN | 102525064 | A | 7/2012 |
| CN | 202489375 | U | 10/2012 |
| DE | 1982824 | U | 4/1968 |
| DE | 3637424 | A1 | 5/1988 |
| DE | 9002279 | U1 | 5/1990 |
| DE | 10034159 | A1 | 1/2002 |
| DE | 10210448 | A1 | 9/2003 |
| DE | 202004003582 | U1 | 5/2004 |
| DE | 202008014890 | U1 | 3/2009 |
| EP | 0142770 | A1 | 5/1985 |
| EP | 0159271 | A2 | 10/1985 |
| EP | 0348014 | B1 | 4/1993 |
| EP | 0853552 | B1 | 3/2000 |
| EP | 0686008 | B1 | 4/2001 |
| EP | 0697827 | B1 | 5/2002 |
| EP | 0900031 | B1 | 5/2003 |
| EP | 1475008 | B1 | 3/2006 |
| EP | 1301101 | B1 | 4/2006 |
| EP | 1925464 | A1 | 5/2008 |
| EP | 1327396 | B1 | 3/2009 |
| EP | 1479310 | B1 | 7/2009 |
| EP | 1718183 | B1 | 9/2011 |
| FR | 2598897 | A1 | 11/1987 |
| FR | 2681827 | A1 | 4/1993 |
| FR | 2742315 | A1 | 6/1997 |
| FR | 2752148 | A1 | 2/1998 |
| FR | 2773681 | B1 | 7/1999 |
| FR | 2804198 | A1 | 7/2001 |
| FR | 2806890 | A1 | 10/2001 |
| FR | 2819156 | A1 | 7/2002 |
| FR | 2820008 | B1 | 8/2002 |
| FR | 2821726 | A1 | 9/2002 |
| FR | 2896221 | B3 | 7/2007 |
| FR | 2904921 | A1 | 2/2008 |
| FR | 2913655 | B3 | 5/2009 |
| FR | 2922733 | A1 | 5/2009 |
| FR | 2958511 | A1 | 10/2011 |
| GB | 1099200 | A | 1/1968 |
| GB | 1406272 | A | 9/1975 |
| GB | 1479136 | A | 7/1977 |
| GB | 1593494 | A | 7/1981 |
| GB | 2168035 | A | 6/1986 |
| GB | 2245250 | A | 1/1992 |
| GB | 2297967 | A | 8/1996 |
| GB | 2298360 | A | 9/1996 |
| GB | 2301089 | A | 11/1997 |
| GB | 2314319 | A | 12/1997 |
| GB | 2377429 | A | 1/2003 |
| GB | 2403211 | A | 12/2004 |
| GB | 2425284 | A | 10/2006 |
| GB | 2429636 | A | 3/2007 |
| GB | 2436486 | B | 1/2008 |
| GB | 2440310 | A | 1/2008 |
| JP | S4849010 | U | 6/1973 |
| JP | S5328008 | U | 3/1978 |
| JP | S53108507 | U | 8/1978 |
| JP | S5426254 | Y2 | 8/1979 |
| JP | S62198170 | U | 12/1987 |
| JP | H041017 | Y2 | 1/1992 |
| JP | H4131317 | U | 12/1992 |
| JP | 2005297952 | A | 10/2005 |
| KR | 20010028666 | A | 4/2001 |
| KR | 100395144 | B1 | 8/2003 |
| KR | 20140011988 | A | 1/2014 |
| NL | 1011099 | C1 | 7/2000 |
| TW | M406968 | U1 | 7/2011 |
| WO | 9522266 | A1 | 8/1995 |
| WO | 0021817 | A1 | 4/2000 |
| WO | 0203829 | A1 | 1/2002 |
| WO | 0228218 | A1 | 4/2002 |
| WO | 0245540 | A1 | 6/2002 |
| WO | 03041529 | A1 | 5/2003 |
| WO | 03063637 | A2 | 8/2003 |
| WO | 0075703 | A1 | 9/2003 |
| WO | 2004030488 | A2 | 4/2004 |
| WO | 2004080230 | A1 | 9/2004 |
| WO | 2004088163 | A2 | 10/2004 |
| WO | 2005041710 | A1 | 5/2005 |
| WO | 2005084481 | A1 | 9/2005 |
| WO | 2007019379 | A2 | 2/2007 |
| WO | 2007041770 | A1 | 4/2007 |
| WO | 2007063302 | A1 | 6/2007 |
| WO | 2007074973 | A1 | 7/2007 |
| WO | 2007079412 | A2 | 7/2007 |
| WO | 2007118705 | A1 | 10/2007 |
| WO | 2007149579 | A2 | 12/2007 |
| WO | 2008046599 | A1 | 4/2008 |
| WO | 2008071873 | A1 | 6/2008 |
| WO | 2008098116 | A1 | 8/2008 |
| WO | 2008100117 | A1 | 8/2008 |
| WO | 2008129577 | A1 | 10/2008 |
| WO | 2009005031 | A1 | 1/2009 |
| WO | 2009006888 | A2 | 1/2009 |
| WO | 2009010049 | A2 | 1/2009 |
| WO | 2009021146 | A1 | 2/2009 |
| WO | 2009029244 | A1 | 3/2009 |
| WO | 2009085334 | A1 | 7/2009 |
| WO | 2010005308 | A2 | 1/2010 |
| WO | 2010077481 | A2 | 7/2010 |
| WO | 2011139700 | A2 | 11/2011 |
| WO | WO2014/042490 | A1 | 3/2014 |
| WO | WO2015/174699 | A1 | 11/2015 |

* cited by examiner

LUGGAGE ASSEMBLY AND A FRAME

CROSS REFERENCE TO RELATED APPLICATION

This application is a National Phase filing under 35 C.F.R. § 371 of, and claims priority to, International PCT Patent Application No.: PCT/EP2014/070169, filed on Sep. 23, 2014, which claims the priority to International Application No.: PCT/EP2013/070625, filed on Oct. 3, 2013, the contents of each of which are hereby incorporated in their entireties by reference.

BACKGROUND

Some embodiments relate to luggage assemblies which include a luggage item, and which includes a wheel assembly for carrying the luggage item. More in particular, some embodiments relate to luggage assemblies which are suitable for being pushed and pulled by a user.

U.S. Pat. No. 5,154,265 discloses a suitcase with retractable wheels. In a first position, the retractable wheels are fully enclosed by an outer surface of the suitcase and in a second position, the retractable wheels are provided below the bottom surface of the suitcase. The bottom surface of the suitcase is, in the cited document, a side of the suitcase where two shells of the suitcase are coupled to each other. When the retractable wheels are at their first position, no wheel protrudes out of the suitcase which results in less damages to the wheels when, for example, the suitcase is transported from check-in counters to an airplane and when the suitcase is loaded into the airplane. When the retractable wheels are at their second position, the suitcase can be carried by its owner. The cited patent uses the term "trolleying" and it means at least that the suitcase can be pulled with a draw bar or draw strip. It might be that the draw bar is also used to push the suitcase.

SUMMARY

A drawback of the known art is that the retractable wheels are provided at such a specific second position by using such a specific unfolding ways that in practical embodiments the owner of the suitcase shall not push the suitcase with the draw bar. The specific second positions result in an unstable suitcase when the owner pushes the suitcase when the wheels are in their second positions—the suitcase may easily tilt and fall on the ground. Furthermore, the wheels may automatically return to their first position when the pushed suitcase has to pass an obstacle, such as a doorstep. Even when all wheels are at their second position and the suitcase is pulled, the suitcase may easily tilt sidewards and fall sidewards. Thus, it is inconvenient for the user to push or pull the suitcase.

Some embodiments provide a user friendly luggage assembly which is suitable for pushing and pulling the luggage assembly such that the luggage assembly provides a stable behavior when being pulled or being pushed. The luggage assembly includes a wheels and a luggage item.

Some embodiments provide a luggage items as defined in the claims. Some other embodiments provide a frame as defined in the claims.

Embodiments are defined in the dependent claims.

A luggage item in accordance with the first aspect of the presently disclosed subject matter includes a luggage item and a wheel assembly. The wheel assembly includes at least one front wheel and includes rear wheels. The rear wheels include a first rear wheel and a second rear wheel. The wheels are moveable between a folded position and an unfolded position. The luggage assembly includes a bottom flank being a surface of the luggage assembly facing, in use, the ground when the luggage item is placed on the ground with the wheels in the unfolded position. The bottom flank has a push direction edge and an opposite pull direction edge. The push direction edge is facing in a forward direction when, in use, the luggage assembly is pushed by a user. The luggage assembly further includes a rear side being a surface of the luggage assembly coupled to the bottom flank at the pull edge. The folded position of the wheels is within the luggage assembly. The unfolded position of the at least one front wheel is completely at a specific side of the bottom flank that faces away from the luggage item and is a position closer to the push direction edge than to the pull direction edge. The unfolded position of the rear wheels is completely at a specific side of the rear side that is facing away from the luggage item. When the luggage assembly touches the ground with the wheels in the unfolded position and when the luggage item is homogeneously loaded, the luggage item has a tilted position with respect to a line perpendicular to the ground in which the rear side tilts towards the ground and has a projected center of gravity of the luggage item is in between the rear wheels and the at least one front wheel. The projected center of gravity of the luggage item is a perpendicular projection of a center of gravity of the luggage item on the ground.

The luggage assembly according to some embodiments has wheels that may be arranged at a folded or an unfolded position. When the at least one front wheel is in the folded position and the rear wheels are in their unfolded position, one has a luggage item that corresponds to known luggage assemblies that can be easily pulled, namely a luggage item with two rear wheels which allow the pulling of the luggage assembly. Furthermore, when all the wheels are in the unfolded position, a relatively large wheel base is created, which is inherently more stable than a short or a small wheel base. Additionally, in this configuration the luggage item is tilted which positions the luggage item in a more stable position which prevents the falling over of the luggage item. More in particular, the fact that the projected point of gravity falls in between the wheels (which have a relatively large wheel base) prevent that the luggage item can easily fall over. When the wheels are in the unfolded position, a user can easily push the luggage assembly and, because of the above discussed characteristics, the pushed luggage item remains in a stable position and the luggage assembly as a whole has a stable road behavior. It is to be noted that when the wheels are all in the unfolded position, the luggage assembly can be pulled as well. It is further to be noted that the luggage item may optionally include two front wheels.

As discussed above, the wheel base is relatively large (at least compared to the size of the bottom flank) and as such it is expected that the at least one front wheel and rear wheels protrude out of the luggage assembly along a relatively long distance. Therefore, in order to have a useful product which is still capable of being pushed or pulled after being checked in for an airplane flight (and, thus, without losing its wheels during baggage handling), it is necessary to have a mechanism which allows the folding in of the wheels. Thus, in the above discussed luggage assembly, the wheels are moveable to their respective folded position and the folded positions of the wheels are within the luggage assembly. Other description of "the wheels are within the luggage assembly" are, when the wheels are in the folded position, they fall within the envelope of the luggage assembly, which means that the wheels do not protrude out of the luggage assembly and the risk of damages of the wheels is reduced when, for example, the luggage assembly is checked in for an airplane flight. The envelope of the luggage assembly is formed by the above defined bottom flank and rear side and other surfaces of the luggage assembly such as a front side which is opposite the rear side, a top flank being opposite the bottom flank, and two side flanks (the flanks separate the front side from the rear side). In general the front side and the rear side each have an area that is larger than each one of the flanks.

A further additional benefit is, when the projected point of gravity is not very close to the point where the at least one front wheel in the unfolded position touches the ground, a user may (temporarily) attach other luggage items to the front side of the luggage assembly without creating an unstable luggage assembly when all the wheels are in their unfolded position. Thus, the luggage assembly provided with a plurality of luggage items maintains its stable road behavior.

In a practical embodiment, surfaces of the luggage item define, when the wheels are in their unfolded position, the front side, the top flank, the first side flank and the second side flank. Other surfaces of the luggage item may define for a large part the rear side of the luggage assembly, and the bottom flank is for the largest part defined by a surface of the wheel assembly that faces away from the luggage item. The outer surfaces of the combination of the wheel assembly and the luggage item form the front side, the rear side and the flanks.

The tilted position of the luggage item must be compared to an untilted position of the luggage item. Untilted means: when all wheels of the luggage assembly are in their folded position, and when the luggage assembly is placed on the ground with its bottom flank, the luggage item is in the untilted position.

The term "completely" in "The unfolded position of the at least one front wheel is completely at a specific side of the bottom flank that faces away from the luggage item" must be interpreted as: the whole at least one front wheel is at the specific side of the bottom flank that faces away from the luggage item. In other words, when it is assumed that the bottom flank defines a virtual plane, this virtual plane does not intersect with the at least one front wheel. This interpretation of completely also applies to "the unfolded position of the rear wheels is completely at a specific side of the rear side that is facing away from the luggage item".

Optionally, the wheel assembly is fastened to the luggage item. In another embodiment, the wheel assembly is fully integrated with the luggage item. In yet a further embodiment, the wheel assembly is detachably assembled to the luggage item, which means that the luggage item can be detachably coupled to the wheel assembly.

Optionally, as discussed above, the luggage assembly may include side flanks which includes a first side flank and an opposite second side flank. Each one of the first side flank and the second side flank is larger than each one of the top flank and bottom flank. Thus, the luggage assembly as a shape of a rectangular box and, when all wheels are in the unfolded position, the luggage assembly has such a shape that its width is relatively small.

Optionally, the luggage assembly includes a front side being a surface of the luggage assembly coupled to the bottom flank at the push edge, the unfolded position of the at least one front wheel is also completely at a specific side of the front side that faces away from the luggage item. Thus, the at least one front wheel is below and in front of the luggage item. Such a position provides a relatively large wheel base for the luggage assembly and, therefore, contributes to a stable luggage assembly when all wheels are in their unfolded position. This position also allows that additional luggage items are coupled to the front side of the luggage item without creating an unstable luggage assembly. It is to be noted that the front side is opposite the rear side. It is further to be noted that, in line with a previous discussion above, the term "completely" as defined in "the unfolded position of the at least one front wheel is also completely at a specific side of the front side that faces away from the luggage item" means that the whole at least one front wheel is at the specific side of the front side that faces away from the luggage item.

Optionally, when the wheels are in their unfolded position and the luggage assembly touches the ground with the wheels, an x-dimension is defined in a direction from a first line defined by a point where the at least one front wheel touches the ground towards a second line parallel to the first line, the second line is defined by points where the rear wheels touch the ground, wherein a position on the first has an x-coordinate of 0 and a position on the second line has the x-coordinate 1, and when the wheels are in their unfolded position, the projected point of gravity has the x-coordinate in a range from 0.2 to 0.9. If the projected point of gravity is not too close to one of the first line or the second line, the luggage assembly is relatively stable. In an embodiment, the projected point of gravity has the x-coordinate in a range from 0.3 to 0.85. In another embodiment, the projected point of gravity has the x-coordinate in a range from 0.5 to 0.82. In a further embodiment, the point of gravity has the x-coordinate in a range from 0.6 to 0.8. It is to be noted that the above defined project point of gravity relates to the situation in which the luggage assembly includes one luggage item. When the projected point of gravity is closer to the rear wheels, a user may (temporarily) attach other luggage items to the front side of the luggage assembly without creating an unstable luggage assembly when all the wheels are in their unfolded position. Thereby, the luggage assembly provided with other luggage items maintains its stable road behavior.

Optionally, the luggage assembly touches the ground with the wheels in the unfolded position, a tilting angle of the luggage item in the tilted position is within a range from 10 degrees to 35 degrees, the tilting angle is defined between a surface of the luggage item which at least partially coincides with the rear side of the luggage assembly and a line perpendicular to the ground. When the tilting angle is within this range, the luggage item obtains a stable position in which the projected point of gravity is well within an area defined by the wheels. In an embodiment, the tilting angle is within a range from 15 to 30 degrees. In another embodiment, the tilting angle is within a range from 20 to 25 degrees. In an embodiment, in the tilted position, the rear side is tilted into the direction of the ground.

Optionally, the front side and the rear side are separated from each other by flanks of the luggage assembly, the flanks include the bottom flank, a top flank, a first side flank and a second side flank. The top flank is opposite the bottom flank. The first side flank is opposite the second side flank. The first rear wheel is arranged to rotate around a virtual first side rotational axis from the unfolded to the folded position, and vice versa, the virtual first side rotational axis is substantially parallel to and close to an intersectional line of the rear side and the first side flank. The second rear wheel is arranged to rotate around a virtual second side rotational axis from the unfolded to the folded position, and vice versa, the virtual second side rotational axis is substantially parallel to and close to an intersectional line of the rear side and the second side flank.

When the rear wheels may rotate around the virtual side rotational axes as defined above the can be advantageously arranged in their folded and in their unfolded position. The trajectory from the folded to the unfolded position (and vice versa) is relatively short and the side rotational axes are arranged at a position which is close to the side flanks of the luggage assembly and, as such, it is prevented that the luggage assembly becomes unstable when the rear wheels are in their unfolded position.

"Substantially parallel" means in the context of this document that when the virtual side rotational axes are not exactly parallel to the intersectional lines, an angle which is formed between the virtual side rotation axes and their respective intersectional line is not larger than 7 degrees, or, optionally, not larger than 5 degrees, or optionally, not larger than 3 degrees. "Close to" means, in this context, that the side rotational axes are arranged within a distance of 10 cm from the above defined intersectional lines. In another embodiment, the side rotational axes are arranged within a distance of 5 cm from the particular intersectional lines. In a further embodiment, the first side rotational axes are arranged within a distance of 3 cm from the particular intersectional lines.

Optionally, the luggage assembly further includes a handle being assembled to the rear side of the luggage assembly. The handle is moveable between a folded position and an unfolded position; the folded position of the handle is within the luggage assembly and the unfolded position is a position at a specific side of the top flank that faces away from the luggage item. A handle that is assembled at the indicated position is useful for a user when he pulls or pushes the luggage assembly. Furthermore, a moveable handle which is in its folded position within the luggage assembly is in particular advantageous because no separate element protrudes out of the luggage assembly. It is to be noted that the handle is in its unfolded position above the luggage or above-behind the luggage item. Thus, this optional embodiment does not limit the unfolded position to a position exactly above the luggage item, but only limits the unfolded position to a position which is in a half space above the luggage item.

Optionally, the wheel assembly includes a first rear rotator for rotating the first rear wheel around the virtual first side rotational axis and a second rear rotator for rotating the second rear wheel around the virtual second side rotational axis. Each one of the rear rotators includes a helix element for transforming a linear movement into a rotational movement. The helix elements include a helix shaped recess for receiving a pin that is coupled to the handle and the pin is only able to move into a linear direction. The rear rotators are efficient and effective way to move the rear wheels from their folded position to their unfolded position and vice versa. Helix elements are space saving elements which are well capable of transforming a linear movement into a rotational movement. Furthermore, when the helix shaped recess receives the pin that is coupled to the handle, the moveable handle can be used as a way to drive the rotation of the rear wheels from their folded to their unfolded position, and vice versa. Optionally, the helix elements are arranged an axis which coincides with the (relevant) virtual side rotation axis.

Optionally, the at least one front wheel is arranged to rotate around a virtual front rotational axis from the unfolded to the folded position, and vice versa, the virtual front rotational axis is substantially parallel to an intersectional line of the front side and the bottom flank, the virtual front rotational axis is inside the luggage assembly close to the intersectional line of the front side and the bottom flank. The use of a rotational movement around the virtual front rotational axis is an advantageous way of moving the at least one front wheel from the folded position to the unfolded position.

Substantially parallel means in the context of this document that, when the virtual front rotation axis is not exactly parallel to the above defined intersectional line, an angle, which is formed between the virtual front rotational axis and the intersectional line, is not larger than 7 degrees, or, optionally, not larger than 5 degrees, or optionally, not larger than 3 degrees. "Close to" means, in this context, that the front rotational axis is arranged within a distance of 10 cm from the above defined intersectional line. In another embodiment, the front rotational axis is arranged within a distance of 5 cm from the particular intersectional line. In a further embodiment, the front rotational axis is arranged within a distance of 3 cm from the particular intersectional line.

Optionally, the wheel assembly includes a front wheel support for carrying the at least one front wheel. The front wheel support includes an arm coupled to an axis coinciding with the virtual front rotational axis, wherein, when the at least one front wheel is in the folded position, the arm extends from the axis in a direction towards the rear side and the at least one front wheel is in between the front side and the rear side. The front wheel support is rotatable around the axis when the luggage item is arranged in a further tilted position, the rotating of the front wheel support moves the at least one front wheel along a trajectory from unfolded position towards another position below the bottom flank to their unfolded positions, or vice versa. In the further tilted position the luggage item is more tilted than in the tilted position. In the further tilted position, assuming that the wheels are touching the ground, the rear side is closer to the ground than it is in the tilted position.

Thus, the front wheel support provides the folded position for the at least one front wheel which is close to the bottom flank of the luggage assembly. Such a folded position prevents that at the front side of the luggage assembly space must be kept available for the wheels which is advantageous because it prevents that specific recesses must be made in a front side of the luggage item. When the front wheel support moves the at least one front wheel from its folded position to its unfolded position, the at least one front wheel first comes out of the bottom flank, rotates towards a position below the bottom flank towards its final unfolded position. In order to allow such a movement via the position below the bottom flank, the luggage item must be tilted more than the luggage item is tilted in the tilted position. In the tilted position, or when the wheels are in their unfolded position, and the luggage item is with its bottom flank arranged on the ground, there is no space available for the movement of the wheels along a free space below the bottom flank—in other words, the bottom flank and/or the ground prevent the movement of the wheels. In the further tilted position, more space becomes available such that the at least one front wheel can rotate through this space from its folded to its unfolded position, or vice versa. A user may, for example, first arrange the rear wheels in the unfolded position, tilt the luggage item further than the tilting position for allowing the movement of the at least one front wheel from the unfolded position to the folded position (and vice versa). In an embodiment, in the further tilted position, the angle between a line following the rear side of the luggage assembly and the line perpendicular to the ground (assuming that the luggage assembly is placed with its rear wheels on the ground, or is placed with the intersectional line of the bottom flank and the rear flank on the ground) is larger than 35 degrees, or, in another embodiment, larger than 30 degrees, or, in yet a further embodiment, larger than 25 degrees. Thus, the further tilted position also includes arranging the luggage item vertically, which means that an angle between the rear side of the luggage assembly (and, thus, luggage item) and the line perpendicular to the ground is about 90 degrees. It is even not essential that, in the further tilted position, the luggage assembly is with the rear wheels on the ground—it might be that the user lifts the luggage item thereby allowing the at least one front wheel to rotate to another position.

It is to be noted that the front wheel support includes an arm for carrying the at least one front wheel and connecting the wheel to an (rotation) axis. The front wheel support may include several arms for carrying the at least one front wheel or a plurality of front wheels and connecting them to the (rotation) axis. It is to be noted that the arms may be rod- or bar-shaped—the term arm is used to express that in a cross-sectional view of the arm, an elongated shape is obtained. This shape may also be obtained in a cross-sectional view when the arm is wall shaped wherein one side of the wall is coupled to the (rotation) axis and an opposite side of the wall is coupled to at least one front wheel.

Optionally, the wheel assembly includes a pedal and a piston assembly. The piston assembly includes a moveable piston and a resilient member for pressing the moveable piston towards an extended position. The pedal is coupled to the piston assembly for compressing the resilient member in response to an operation of the pedal by a user. The piston assembly being arranged for storing mechanical energy in the resilient member for rotating the at least one front wheel (and, optionally, the wheel support) when the luggage item is in a further tilted position. The piston assembly allows the temporarily storage of energy by compressing the resilient member of the piston assembly. In this specific optional embodiment, the piston assembly is coupled to the at least one front wheel (and/or to the front wheel support) for, as soon as the luggage item is arranged by a user in the further tilted position, rotating the at least one front wheel around the (rotation) axis from the folded position towards the unfolded position (or vice versa). Thus, the piston assembly and the pedal make it convenient for a user to change the position of the at least one front wheel. When the luggage assembly is, for example, arranged in an untilted position (which means that the bottom flank is substantially parallel to the ground), the user may press the pedal with one of his feet to provide the amount of energy that is needed to rotate the at least one front wheel to another positions, and only when he subsequently tilts the luggage assembly towards the further tilted position, the a least one front wheel moves to another positions. Thereby the user does not have to tilt the luggage item to the further tilted position and push the pedal simultaneously—simultaneously operating the pedal and tilting the luggage assembly might be relatively inconvenient. When the luggage item is in the tilted position, it may still be able to operate the pedal easily.

It is to be noted that the piston may move within a hollow body, such as for example a cylinder, or hollow body of which the cross-sectional shape of the recess is, for example, square shaped. The function of the cylinder is, for example guiding the movement of the piston. In another embodiment, the piston assembly may include a body around which the resilient and the piston are arranged; for example, the piston may be hollow at one side and in such a recess the piston receives the resilient member (e.g. a spring) and the body. The function of the body is to guide the piston in a specific direction, in other words, to prevent that the piston moves in direction perpendicular to the specific direction. It is further to be noted that also, in another embodiment, the user may operate the pedal thereby operating the front wheel rotational mechanism when the luggage item is in the further tilted position, however, this might not be the most convenient position of the luggage item to operate the pedal when the pedal is arranged close to a back side of the luggage assembly.

Optionally, the wheel assembly also includes an U-recessed element and the piston assembly also includes a switching element. The U-recessed element is arranged rotatable around and axis and is coupled to the at least one front wheel for rotating the at least one front wheel around the virtual front rotational axis when the U-recessed element rotates. The U-recessed element includes a recess which includes a first edge and a second edge at opposite sides of an opening of the recess. The recess is arranged for receiving a portion of the switching element. The switching element is coupled to the piston by a switching axis and the switching element is arranged rotatable around the switching axis and is partially rotatable from a neutral position into a first rotation direction and in a second rotation direction. The U-recessed element and the switching element are positioned with respect to each other such that, when energy is stored in the resilient element of the piston assembly, the piston pushes the switching element towards the U-recessed element thereby obtaining contact between the switching element and first edge or the second edge of the U-recessed element such that the U-recessed element receives a force, respectively, in a first direction or in a second direction for obtaining, when the luggage item is arranged in the further tilted position, a movement of the at least one front wheel from the folded position to the unfolded position, or vice versa.

This specific optional embodiment provide ways which use energy stored in the resilient element of the piston assembly to move the at least one front wheel from the folded position towards the unfolded position, and vice versa. The mechanism is able to rotate the at least one front wheel in two opposite directions, while the piston of the piston assembly only operates under influence of the resilient element into one direction. In particular the interaction between the U-recessed element and the switching element contributes to the fact that one direction of the piston may result in different rotational directions of the at least one front wheel. In this mechanism the position of the U-recessed element depends on the position of the at least one front wheel. When the at least one front wheel is in one specific position, the first edge of the U-recessed element faces the switching element, and when the at least one front wheel is in another position, the second edge of the U-recessed element faces the switching element. Thus, the position of the U-recessed element functions as a sort of "memory" of the position of the front wheel(s). Subsequently the switching element pushes against one of the edges (while the switching element partially rotates either in the first rotation direction or in the second rotation direction) such that a force is applied to the U-recessed element. This force has such a direction that the U-recessed element has the tendency to rotate into a first direction or into a second direction such that the at least one front wheel also rotate into a specific direction. However, as long as the luggage item is not in the further tilted position, the front wheel(s) cannot freely move, and the U-recessed element also receives a force from the front wheel(s) resulting in a situation wherein the switching element remains pushing against the U-recessed element. As soon as the luggage item is arranged in the further tilted position, the at least one front wheel may freely move and the force that is being applied by the switching element towards the U-recessed element is large enough to rotate the U-recessed element and, thus, the at least one front wheel. This optional embodiment provides a very user-friendly way of allowing a user to move the at least one front wheel from the folded position towards the unfolded position (and vice versa) because, when the luggage item is not in the further tilted position, the pedal is well-accessible such that the user can push on the pedal to store energy in the resilient element. Subsequently the user may release his foot from the pedal and the user may chose at which particular moment in time he arranges the luggage item in the further tilted position resulting in the movement of the at least one wheel.

It is to be noted that the mechanism of moving the at least one front wheel of this optional embodiment does not directly depends on characteristics of mechanism to move the rear wheels. Thus, optionally, the above optional embodiment may be considered to be an independent embodiment.

It is to be noted that, although the above optional embodiment suggests that the switching element always returns to one specific neutral position, there may be one or more neutral positions. For example, when the switching element has partially rotated in the first direction and returns to its neutral position, the switching element may end up at a specific position that is slightly different from the position where it would end up when the switching element has partially rotated in the second direction and returns to its neutral position. Thus, the neutral position may be a relatively short range of rotational positions which are in between a first rotated position and a second rotated position.

Optionally, the luggage item includes a suitcase. In another optional embodiment, the luggage assembly includes a second luggage item, which might also be a suitcase.

Optionally, when the luggage assembly includes a handle that is being assembled to the rear side of the luggage assembly, and when the rear wheels are in their unfolded position and the wheels touch the ground, the luggage assembly is suitable for being pushed by a user, and when at least the rear wheels are in their unfolded position, the luggage assembly is suitable for being pulled by the user. It is to the noted that the user may use the handle to pull the luggage assembly and the user may use the handle to push the luggage assembly.

Optionally, the luggage assembly may include a frame which includes the wheel assembly. The luggage item may be releasable attached to the frame.

Optionally, the luggage assembly includes a handle and the frame includes the handle.

According to some embodiments, a frame is provided for carrying a luggage item which includes a wheel assembly of any one of the above discussed wheel assemblies. In an embodiment the frame includes a foldable handle. In another embodiment the frame includes ways to releasable attach the luggage item to the frame.

These and other aspects of some embodiments are apparent from and will be elucidated with reference to the embodiments described hereinafter.

It will be appreciated by those of ordinary skill in the art that two or more of the above-mentioned options, implementations, and/or aspects of the some embodiments may be combined in any way deemed useful.

Modifications and variations of the system, the method, and/or of the computer program product, which correspond to the described modifications and variations of the system, can be carried out by a person of ordinary skill in the art on the basis of the present description.

BRIEF DESCRIPTION OF THE DRAWINGS

These and other aspects of some embodiments are apparent from and will be elucidated with reference to the embodiments described hereinafter. In the drawings, FIG. 1 schematically shows an embodiment of the luggage assembly, FIG. 2 schematically shows a side view of the embodiment of the luggage assembly, FIG. 3 schematically shows a cross-sectional view of the luggage assembly along a plane that is parallel to and close to the rear side of the luggage assembly, FIG. 4 schematically shows a cross-sectional view of the wheel assembly along a plane that is parallel to the bottom flank, FIG. 5 schematically shows a cross-sectional view of a portion of the wheel assembly, the shown portion relates to a mechanism of rotating the front wheels, FIG. 6 schematically shows a cross-sectional view of the portion of the wheel assembly wherein the front wheels are rotated to their folded position, FIG. 7 schematically shows a cross-sectional view of the portion of the wheel assembly wherein the front wheels are rotated to their folded position and the pedal is operated by a user, FIG. 8 schematically shows a cross-sectional view of the portion of the wheel assembly wherein the front wheels are rotated to their unfolded position, FIG. 9 schematically shows front view of the luggage item together with parts of the wheel assembly, FIG. 10 schematically shows a front view of the luggage item together with parts of the wheel assembly, FIG. 11 schematically shows a bottom view of the luggage assembly, and FIG. 12 schematically shows a side view of a frame according to an embodiment.

It should be noted that items which have the same reference numbers in different Figures, have the same structural features and the same functions, or are the same signals. Where the function and/or structure of such an item has been explained, there is no necessity for repeated explanation thereof in the detailed description.

The Figures are purely diagrammatic and not drawn to scale. Particularly for clarity, some dimensions are exaggerated strongly.

DETAILED DESCRIPTION OF EXEMPLARY EMBODIMENTS

In the following of this application embodiments are shown in which the luggage assembly has two front wheels. The disclosure of this document is not limited to embodiments with exactly two front wheels. Instead of two front wheels, all embodiments may have one front wheel which is arranged in central position between the drawn positions of the two front wheels. In other embodiment, the luggage assembly even has more than two front wheels or more than two rear wheels.

Figure 1:
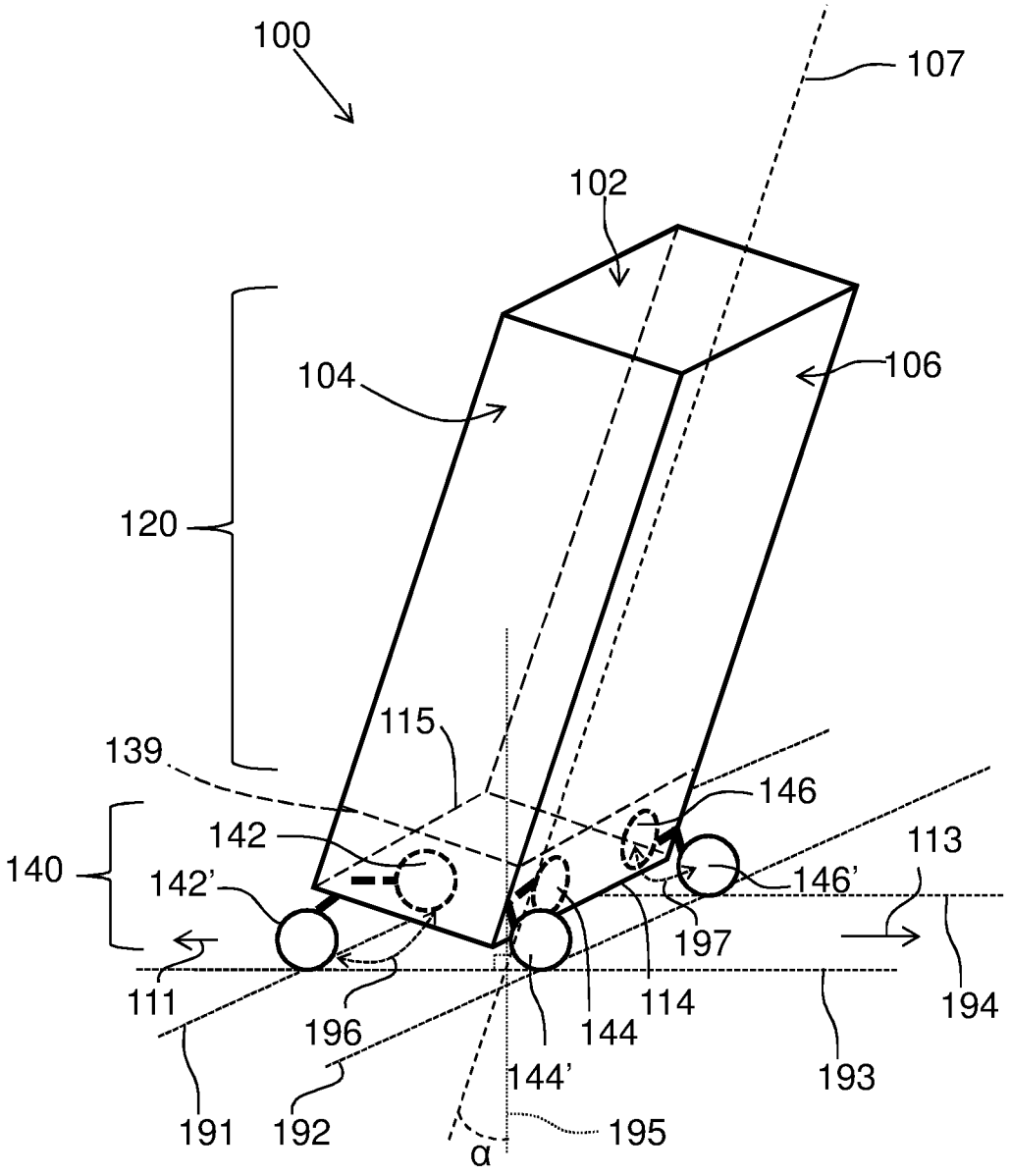

FIG. 1 schematically shows an embodiment of the luggage assembly 100. The luggage assembly 100 includes a wheel assembly 140 and a luggage item 120. In FIG. 1 the transition from wheel assembly 140 to luggage item 120 is schematically indicated by lines 139. In practical embodiment the transitional interface is not exactly a plane, but may be formed by a (virtual) surface having recesses and protrusions. In practical embodiments, the wheel assembly 140 is as small as possible and a relatively large portion of the luggage assembly which does not directly relate to the wheels is the luggage item 120. The luggage item 120 may be permanently fasted to the wheel assembly 140, but in other embodiments, the luggage item 120 is detachably fastened to the wheel assembly 140.

The wheel assembly 140 has front wheels of which one front wheel 142, 142' is drawn. Another front wheel is provided near the (bottom) corner of the luggage assembly that is not shown in FIG. 1. The wheel assembly 140 has two rear wheels 144, 144', 146, 146'. All wheels 142, 144, 146 are moveable between two positions, namely a folded position and an unfolded position. When the wheels 142, 144, 146 are drawn in their unfolded position, the reference numbers are 142', 144', 146'. When then wheels are in their folded position, their reference numbers are 142, 144, 146. In FIG. 1 two arrows 196, 197 indicate an example of a movement trajectory of wheels 142, 146 when they move between their folded and unfolded position.

When the wheels 142, 144, 146 are in their folded positions, they are within the luggage assembly 100 and do not protrude out of the luggage assembly 100. In the configuration with the folded wheels 142, 144, 146, the luggage assembly 100 has outer surfaces which are termed as follows: a front side (not shown) and a rear side 106 opposite the front side, a top flank 102, and a bottom flank (not shown) opposite a top flank, a first side flank 104 and a second side flank (not shown) opposite the first side flank 104. The bottom flank is a surface of the luggage assembly 100 which is facing the ground when the luggage assembly 110 is arranged, in use, with its wheels on the ground. The bottom flank has a push direction edge 115 and a pull direction edge 114. The pull direction edge 114 is opposite the push direction edge 115. The push direction edge 115 is an edge of the bottom flank which is arranged, in use, in a forward direction when the user pushes the luggage assembly into a push direction 111. The pull direction edge 114 is an edge of the bottom flank which is arranged, in use, in a forward direction when the user pulls the luggage assembly. The outer surfaces define an envelope of the luggage assembly 100. It might be that the outer surface locally include a hole or an opening and it might be that the outer surfaces of the luggage assembly 100 are slightly curved and that the corner are also curved instead of the shown abrupt corners. For example, the intersection/corner between, for example, the rear side 106 and the first side flank 104 may be curved surface which has, in a cross-sectional view, a shape of a quarter of a circle. Thus, when in the following of this document the terms front side, rear side 106, top flank 102, bottom flank, first side flank 104 and second side flank are used, or other terms relating to these surfaces are introduced, the terms are used as if they are an ideal (virtual) flat surface which are follow for the largest part a real surface of the luggage item 100.

When the wheels 142', 144', 146' are in their unfolded position, they are arranged at a specific position outside the (virtual) box that is defined by the front side, rear side 106, top flank 102, bottom flank, first side flank 104 and second side flank. The front wheels 142' are in their unfolded position below or below and in front of the luggage assembly 100 at a position that is closer to the front side than to the rear side 106. A plane which coincides with the bottom flank subdivides the space into two half spaces. One half space includes the luggage item and the other half space faces away from the luggage assembly. Below the luggage assembly 100 means a position which is in the other half space that faces away from the luggage item.

The rear wheels 144', 146' are in their unfolded position behind or behind/below the luggage assembly 100. A plane that coincides with the rear side 106 subdivides the space into two half spaces. One half space includes the luggage item, and the other half space faces away from the luggage assembly 100. A position behind the luggage assembly 100 is a position in a half space defined by the rear side which half space faces away from the luggage assembly 100.

In addition, the unfolded positions of the wheels 142', 144', 146' are such that, when all wheels 142', 144', 146' are in the unfolded position and the wheels touch the ground, the luggage item 120 is arranged in a titled position. In this tilted position an angle $\alpha$ is formed between the rear side 106 and a line 195 perpendicular to the ground; the angle $\alpha$ is different from 0. Furthermore, the luggage item 120 has a point of gravity. More in particular, when the luggage item 120 is homogeneously loaded its point of gravity is in the center of the luggage item 120. The positions of the wheels 142', 144', 146' in their unfolded position are such that when the point of gravity of a homogeneously loaded luggage item is perpendicularly projected on the ground, the projected point of gravity is in between the front wheels 142' and the rear wheels 144', 146'. In FIG. 1 two lines 191, 192 are drawn, respectively, through the points where the front wheels 142' and the rear wheels 144', 146' touch the ground. The projected point of gravity is in between the lines 191, 192. Two other lines 193, 194 are drawn as well. Line 193 is drawn though the points where the left wheels 142', 144' touch the ground and line 194 is drawn through the points where the right wheels 146' touch the ground. The project point of gravity also is in between these lines 193, 194. When the projected point of gravity is, as discussed above, in between the lines 191, 192, and more advantageously also in between the lines 193, 194, the luggage assembly 100 has a stable position on the ground also when the luggage assembly 100 is pushed or pulled when all the wheels 142', 144', 146' are in the unfolded position.

Figure 2:
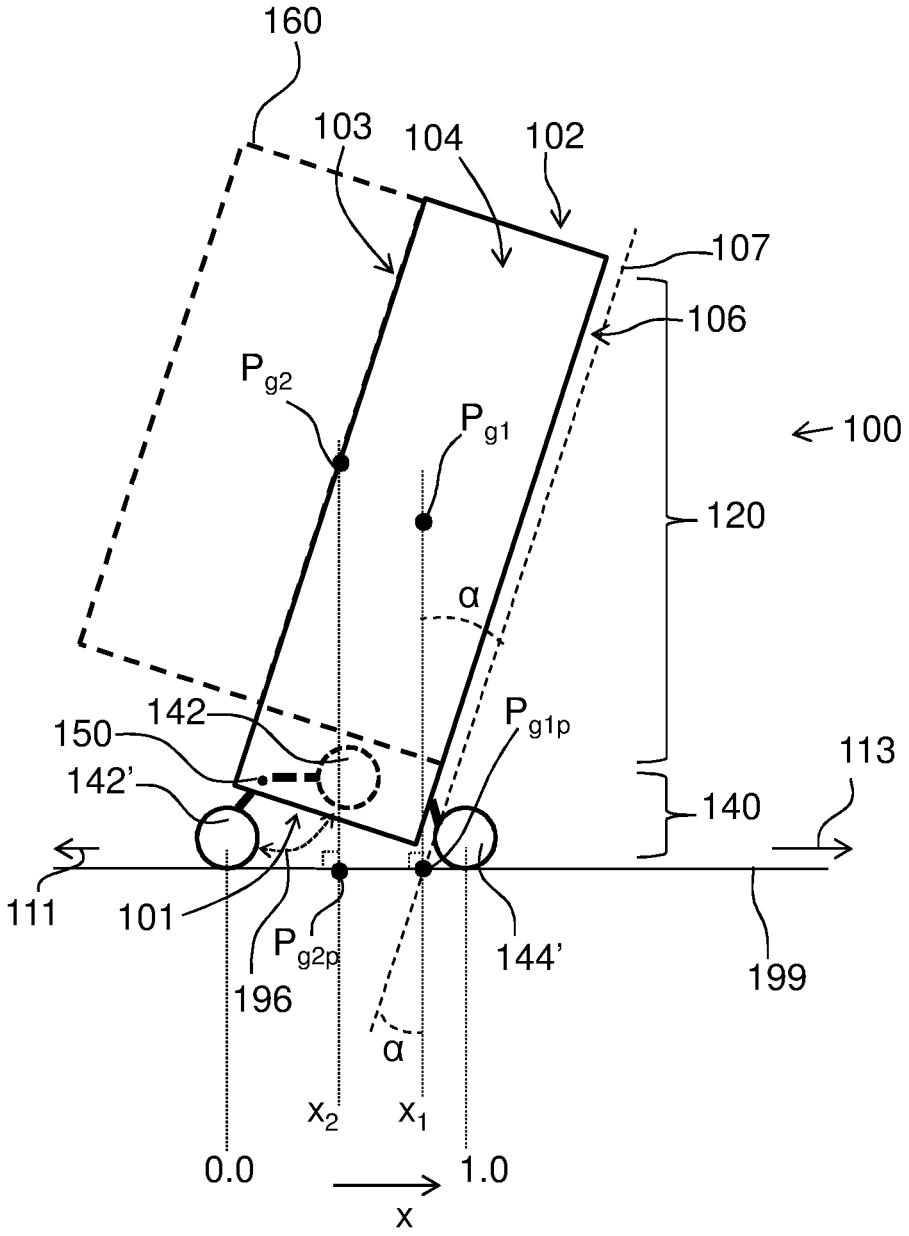

FIG. 2 schematically shows a side view of the embodiment of the luggage assembly 100. The luggage item 120 and the wheel assembly 140 are indicated in the Figure. The presented side view relates to an arrangement of the wheels 142', 144' in their unfolded position and when the unfolded wheels 142', 144' are placed on the ground of which the surface is schematically indicated with line 199. In the side view one looks towards the first side surface 104 of the luggage assembly 100. In FIG. 2 it can be seen how one of the front wheel 142', 142 is moveable between its folded and unfolded position and that the folded position is within the luggage assembly 100. It is also seen in FIG. 2 that when the wheels 142', 144' are in the unfolded position and are placed on the ground, the luggage item 120 is tilted such an angle $\alpha$ between a line 10, which follows the rear side of the luggage assembly 100, and a line 192, which is oriented perpendicular to the ground, is larger than 0.

In the side-view of FIG. 2 the point of gravity $P_{g1}$ of the luggage item 120 has been indicated assuming that the luggage item 120 is homogeneously loaded. Homogeneously loaded ways: the luggage item 120 may be empty (homogeneously filled with air) or, in an example, the luggage item 120 may be homogeneously filled with clothes or other goods. It is assumed that the above discussed loads have everywhere within the luggage item the same mass density. The point of gravity Pg1 of the luggage item 120 is in the center of the luggage item 120. When the luggage item is perpendicularly projected on the ground (as indicated with line 199) a projected point of gravity Pg1*p* is obtained. The projected point of gravity Pg1*p* is in between the front wheel 142' and the rear wheel 144'.

The luggage assembly 100 may includes a further luggage item 160 which is coupled to the front side of the luggage item 120. Because of the further luggage item 160, the common point of gravity Pg2 of the combination of the luggage item 120 and the further luggage item 160 is different from the point of gravity Pg1 of the luggage item 120 alone. It is assumed that the luggage item 120 and the further luggage item 160 are both uniformly loaded with materials of the same mass density. This also results in another common projected point of gravity Pg2*p* when the common point of gravity is also perpendicularly projected on the ground. Also the common projected point of gravity Pg2*p* is within the points where the front wheel 142' and the rear wheel 144' touch the ground. Thus, even with two luggage items a very stable luggage assembly is created and the luggage assembly maintains its stage road behavior.

The plane of FIG. 2, in a direction from left to right, forms the x-dimension as indicated at the bottom end of the Figure. By way of definition, the point where the front wheel 142' touches the ground has the x-coordinate 0. By way of definition, the point where the rear wheel 144' touches the ground has the x-coordinate 1. This is also shown in the bottom end of the Figure. The projected point of gravity Pg1*p* and the common projected point of gravity Pg2*p* have, respectively, the x-coordinates x1 and x2. Because the projected point of gravity Pg1*p* and the common projected point of gravity Pg2*p* are in between the front wheels 142' and the rear wheels 144', x1 and x2 have a value in the range from 0 to 1. In an embodiment, they have a value in the range from 0.2 to 0.9. In yet a further embodiment, they have a value in the range from 0.3 to 0.85. In yet an additional embodiment, they have a value in the range from 0.4 to 0.8.

In FIG. 2 a point 150 indicates a location of a front rotational axis. The front rotational axis extends perpendicular to the plane of FIG. 2 and is provided within the wheel assembly 140. The front wheels 142' make a rotational movement around the front rotational axis when they move from the folded position to the unfolded position (and vice versa). The movement trajectory 196 of the front wheel 142' during the rotation movement is from the interior of the luggage assembly 100 (where the front wheels 142 are in their folded position) towards a position at the bottom flank where they leave the interior of the luggage assembly towards a position below the bottom flank towards the unfolded position of the front wheels 142'. This rotational movement can only be made when the luggage item 120 is positioned in a further tilted position. In the further tilted position the angle $\alpha$ is larger than it would be when all wheels 142', 144' of the luggage assembly 100 are in their unfolded position and when the wheels 142', 144' touch the ground.

A specific front wheel support may be provided between the front rotational axis and the wheels. The front wheel support may include one or more structures that are coupled to the front rotational axis and are coupled to the wheels. The one or more structures have, in a cross-sectional view along a plane parallel to the first side flank 104, a shape of an arm, which means that they have an elongate shape. Thus, the one or more structures may include a wall-shaped element, or one or more rod/bar shaped elements.

Because FIG. 2 presents a side-view, FIG. 2 also shows an edge of the front side 105, the top flank 102, the rear side 106 and the bottom flank 101. When the luggage assembly is placed, in use, with its wheels on the ground, the bottom flank 101 faces the surface ground, which is schematically indicated by line 199. Also the push direction 111 and the pull direction 113 are indicated in FIG. 2.

Figure 3:
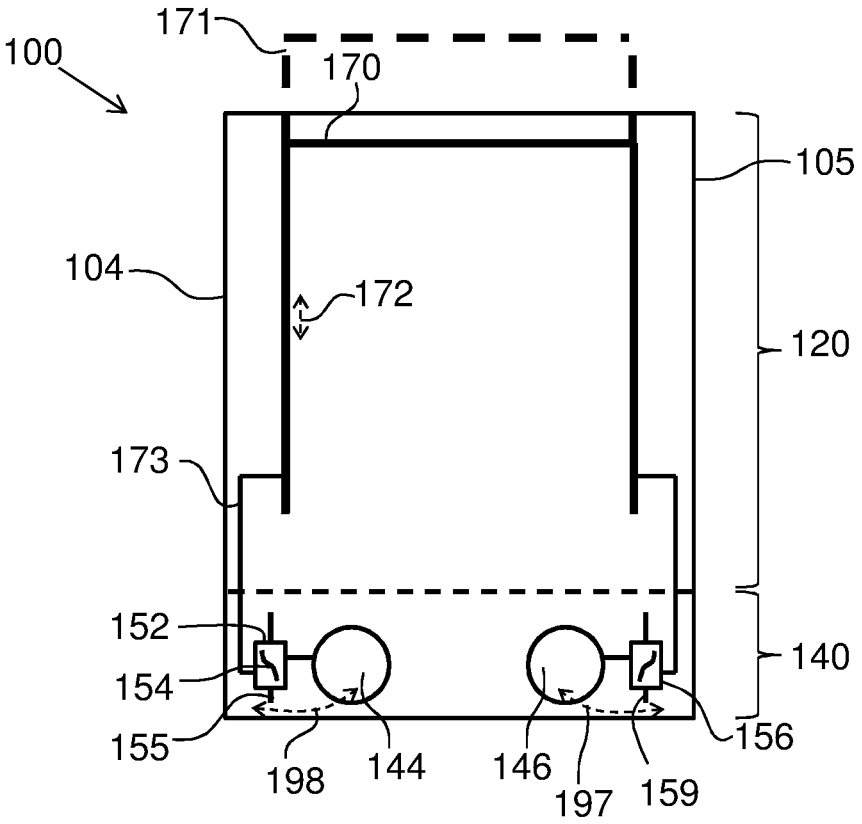

FIG. 3 schematically shows a cross-sectional view of the luggage assembly 100 along a plane that is parallel to and close to the rear side of the luggage assembly 100. FIG. 3 also shows that the luggage assembly 100 is subdivided into a wheel assembly 140 and a luggage item 120. The cross-sectional view is taken along a plane that is in the interior of the luggage assembly 100 and shows a handle 170, helix elements 152, 156 and the rear wheels 144, 146 in their folded position. The handle 170 is moveable between a folded position which is indicated by handle 170 and an unfolded position which is schematically shown by the dashed handle 171. The handle 170 is able to make a linear movement 172 between the folded and unfolded position. In the unfolded position a substantial part of the handle 170 is present above the luggage assembly 100, which means that this substantial part is present in a half space defined by a plane following the top flank of the luggage item 120 and this half plane faces away from the luggage item 120. It is to be noted that the handle 171 in its unfolded position may also be above and behind the luggage assembly.

The rear wheels 144, 146 are each coupled to a helix element 152, 156. They are coupled, for example, by an arm to the helix element 152, 156. The helix elements 152, 156 allow the rear wheels 144, 146 to rotate around an axis from their folded to their unfolded position. Thus, the first rear wheel 144 is coupled to a first helix element 152 which is arranged for allowing the first rear wheel 144 to rotate around a first side rotational axis 155. When the first rear wheel 144 rotates around the first side rotational axis 155, it follows the indicated trajectory 198. The second rear wheel 146 is coupled to a second helix element 156 which is arranged for allowing the second rear wheel 146 to rotate around a second side rotational axis 159. When the second rear wheel 146 rotates around the second side rotational axis 159, it follows the indicated trajectory 197.

Each helix element 152, 156 includes a helix shaped recess 154. The helix shaped recesses 154 receive a pin that is coupled to the handle 170. Thus, the pin may move in a linear direction. When the pin moves lineally through the helix shaped recess 154, the helix element 152, 156 rotates around their side rotational axes 155, 159. The pins are coupled by a coupling mechanism 173 to the handle 170.

The first side rotational axis 155 is arranged within the luggage assembly 100 and is arranged close to a first intersectional line of the rear side and the first side flank 104. The first side rotational axis 155 is also arranged substantially parallel to the first intersectional line. "Close to" means, in this context, that the first side rotational axis 155 is arranged within a distance of 10 cm from this particular intersectional line. In another embodiment, the first side rotational axis 155 is arranged within a distance of 5 cm from this particular intersectional line. In a further embodiment, the first side rotational axis 155 is arranged within a distance of 3 cm from this particular intersectional line. The second side rotational axis 159 is arranged within the luggage assembly 100 and is arranged close to a second intersectional line of the rear side and the second side flank 105. The second side rotational axis 159 is also arranged substantially parallel to the second intersectional line. "Close to" means, in this context, that the second side rotational axis 159 is arranged within a distance of 10 cm from this particular intersectional line. In another embodiment, the second side rotational axis 159 is arranged within a distance of 5 cm from this particular intersectional line. In a further embodiment, the second side rotational axis 159 is arranged within a distance of 3 cm from this particular intersectional line.

The helix elements 152, 156 receive in their helix shaped recess a pin that is coupled with a coupling mechanism 173 to the handle 170. When the handle 170 moves 172 in a linear direction, the coupling mechanism 173 transfers the linear movement 172 of the handle 170 towards a linear movement of the pins resulting in a rotational movement of the helix elements 152, 156. The coupling mechanism 173 may include several ways for transforming a relatively long linear movement of the handle 170 into a relatively short linear movement of the pins. The coupling mechanism 173 may include bars, rods, cables, gears, etc. for obtaining this specific transformation towards the relatively short linear movement.

It is to be noted that the mechanism to move the rear wheels 144, 146 from their folded position to their unfolded position may also include ways for locking the wheels at their folded or unfolded position. For example, when the wheels have been moved from the folded to the unfolded position, a locking mechanism prevents that the wheels may return to the folded position without interaction of the user. For example, when the handle 171 is at its unfolded position and when the handle is moved back to the folded position by the user, the locking mechanism releases the rear wheels 144, 146 and the pins that are coupled to the handle 171 and is provided in the helix recesses force the wheels to move back to their folded position. When the rear wheels 144, 146 return to their folded position, they may be locked by another locking mechanism which may also be release in response to an operation of the handle 170.

Alternatively or in addition, the handle 170 includes a locking and unlocking button that may be operated by a user. For example, when the handle 170 is in the folded position and when the handle 170 is in the unfolded position, the position of the handle may be automatically locked and such a button on the handle 170 may be operated by the user to unlock the handle 170 from its folded or its unfolded position such that it can be linearly moved 172 to the other position. It is to be noted that such a button of the handle 170 may also or may alternatively be coupled to the locking and unlocking the position of the rear wheels 144, 146 to lock and/or unlock the position of the rear wheels 144, 146. Because such a button on the handle 170 may be accidentally operated, a secondary locking mechanism may be provided to lock the position of the button on the handle 170. The secondary locking mechanism is, for example, a bolt which cooperates with a recess in the button on the handle 170 for locking the position of the button on the handle 170.

Figure 4:
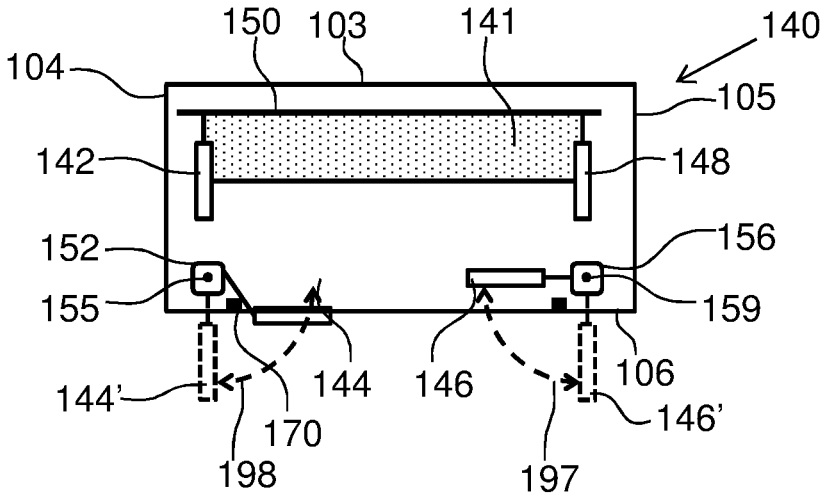

FIG. 4 schematically shows a cross-sectional view of the wheel assembly 140 along a plane that is parallel to the bottom flank. The cross-sectional view presents, with respect to the rear wheels 144, 146, the subsequent elements: the first side rotational axis 155 around which the first helix element 152 is arranged, the first rear wheel 144 in the folded position and the first rear wheel 144' in the unfolded position, the movement trajectory 198 of the first rear wheel 144 when it moves from the folded position to the unfolded position (and vice versa), the second side rotational axis 159 around which the second helix element 156 is arranged, the second rear wheel 146 in the folded position and the second rear wheel in the unfolded position 146' and the movement trajectory 197 of the second rear wheel 146 when it moves from the folded position to the unfolded position (and vice versa).

FIG. 4 shows the front wheels 142, 148 in their folded position within the luggage assembly. The front wheels 142, 148 are coupled to a front wheel support 141 which is, in the embodiment of FIG. 4, a wall-shaped element that is coupled to a front wheel rotational axis 150 and that is coupled to the front wheels 142, 148. The front wheel support (and, thus, the front wheels 142, 148) may rotate around the front rotational axis 150. The movement trajectory of the front wheels 142, 148, when they move from the folded position to the unfolded position, is presented in and discussed in the context of FIGS. 1 and 2.

Alternatives for the wall-shaped element that is coupled to the front wheel rotational axis 150 and to the front wheels 142, 148 are, for example, one or more rods or bars. One or more rods or bars may also form one or more forks to carry the front wheels 142, 148.

The front wheel rotational axis 150 is arranged within the luggage assembly and is oriented substantially parallel to an intersectional line of the front side 103 and the bottom flank of the luggage assembly. The front wheel rotational axis 150 is provided close to the intersectional line. "Close to" means, in this context, that the front wheel rotational axis 150 is arranged within a distance of 10 cm from this particular intersectional line. In another embodiment, the front wheel rotational axis 150 is arranged within a distance of 5 cm from this particular intersectional line. In a further embodiment, the front wheel rotational axis 150 is arranged within a distance of 3 cm from this particular intersectional line.

Figure 5:
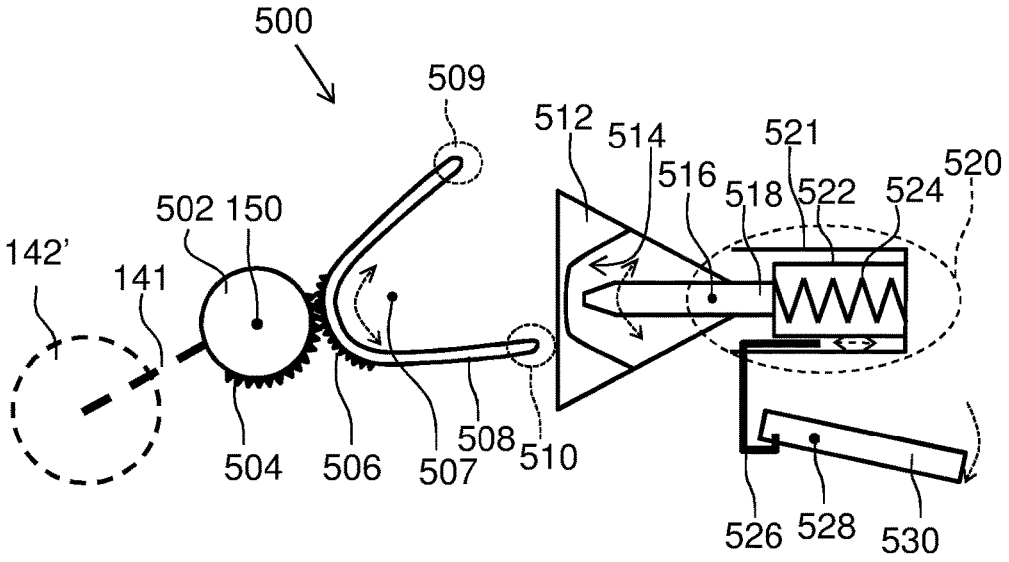

FIG. 5 schematically shows a cross-sectional view of a portion 500 of the wheel assembly. The presented portion 500 relates to a mechanism of rotating the front wheels 142'. In particular, FIG. 5 shows that the wheel assembly includes a pedal 530 which is, for example, arranged rotatable around a pedal rotation axis 528. The wheel assembly further includes a piston assembly 520 which is coupled via a coupling 526 to the pedal 530. The piston assembly 520 includes a cylinder 521 in which a moveable piston 522 is arranged. The piston assembly 520 also includes a resilient element, for example, a spring 524. The spring 524 presses to the moveable piston 522 such that the piston 522 is pressed towards an extended position (see FIG. 6 and FIG. 8). The coupling 526 is arranged such that when a user pushes with his feet on the pedal 530, the rotation of the pedal is transformed into a linear movement of the piston such that the spring 524 is compressed and that energy is stored in the spring 524. The configuration shown in FIG. 5 relates to a situation in which a user has pushed the pedal 530 downwards such that the spring 524 is compressed as far as possible and the piston 522 is as far as possible within the cylinder 521. The pedal 530 may include another spring for moving the pedal 530 back to a neutral position (such as, for example, shown in FIG. 6 and FIG. 8). The coupling 526 between the pedal 530 and the piston assembly 520 is such that only when the user pushes the pedal 530 (in a downwards direction) the piston 522 moves lineally in a direction to the interior of the cylinder 521. When the pedal 530 is operated into another direction or the pedal 530 moves to its neutral position, the coupling does not provide any specific force to the piston 522. Thus, when the piston 522 is, as far as possible, inside the cylinder 521, the spring 524 presses to the piston 522 such that the piston 522, when possible, moves towards the extended position. The coupling 526 may include gears, rods, bars, cables, etc. for obtaining and allowing the above describe movement of the piston assembly 520. As will be discussed hereinafter, when the luggage item is in the further tilted position, the energy stored in the spring 524 may be used to rotate the front wheels 142' from their unfolded position to their folded position (and vice versa). It is to be noted that in the example of FIG. 5 the piston 522 is arranged within the cylinder 521. In another embodiment, within the interior of the cylinder 521 is only provided the spring 524 and the piston 522 is arranged around the cylinder 521. In general the cylinder 521 has a fixed position within the wheel assembly and the piston 522 may move with respect to the cylinder 521. It is not necessary that the piston 522 and/or the cylinder 521 have circular cross-sectional shape. In other embodiments the piston 522 and/or the cylinder 522 may have a square or triangular cross-sectional shape.

FIG. 5 further shows also a mechanism which is used to rotate the front wheels 142' from their unfolded position (as shown in FIG. 5) to their unfolded position when the luggage item is in its further tilted position. At the left end of FIG. 5 one of the front wheels 142' is drawn which is coupled to a front wheel support 141 which is subsequently coupled to a partially toothed wheel 502 (or partially toothed cylinder). The partially toothed wheel 502 is arranged rotatable around the front wheel rotational axis 150. A portion of the outer surface of the partially toothed wheel 502, which is a surface that faces away from the front wheel rotation axis 150, includes teeth for interacting with teeth of another element. The partially toothed wheel 502 interacts with a partially toothed U-recessed element 508. FIG. 5 only shows a cross-sectional view of the partially toothed U-recessed element 508 thereby showing a U-shaped element, however, in a position in front of the plane of FIG. 5 or at a position behind the plane of FIG. 5 the partially toothed U-recessed element 508 element may also include a wall or the like. The partially toothed U-recessed element 508 is arranged rotatable around axis 507. A wall of the partially toothed U-recessed element 508 may be coupled to the axis 507. A surface of the partially toothed U-recessed element 508 may include teeth 506 and the partially toothed U-recessed element 508 is arranged at such a position that the teeth 506 cooperate with the teeth 504 of the partially toothed wheel 502. Thus, when the partially toothed U-recessed element 508 rotates around its rotation axis 507, the partially toothed wheel 502 rotates around the front wheel rotation axis 150 thereby moving the front wheels 142' to another position. The surfaces with the teeth 504, 506 may both have a specific radius with respect to their respective rotational axis, and the ratio between these radii define along which angular distance the partially toothed U-recessed element 508 has to rotate to move the front wheels 142' from their folded position to their unfolded position (and vice versa). The partially toothed U-recessed element 508 includes a recess which has a shape similar to the inner space of the letter U. At the side where the recess is open to receive another elements, the walls of the partially toothed U-recessed element 508 have a first edge 509 and a second edge 510. The first edge 509 and second edge 510 are separated from each other by an opening which provides access to the recess and are arranged at opposite sides of the opening.

The piston 522 of the piston assembly 520 is coupled to an elongated protrusion 518 which is coupled to a switching element 512. The switching element 512 is coupled via an axis 516 to the elongated protrusion 518 and the coupling between the switching element 512 and the elongated protrusion 518 may include a resilient member which pushes the switching element 512, when possible, to a neutral position (as shown in FIG. 5). The switching element 512 may rotate from the neutral position in a first direction and may rotate from the neutral position in a second direction. The rotation into the first direction or the second direction is limited to a specific predefined angular distance. This limitation is defined by a specific interaction between element which coupled the switching element 512 to the elongated protrusion 518. In the example above this coupling element is the axis 516.

The switching element 512 and the partially toothed U-recessed element 508 have relative positions with respect to each other such that, when the piston assembly 520 pushes the switching element 512 into a direction of the partially toothed U-recessed element 508, the switching element 512 pushes against either the first edge 509 or the second edge 510 of the partially toothed U-recessed element 508. Thereby the switching element 512 rotates along the limited predefined angular distance in, respectively, the first direction or the second direction. When the switching element 512 has been rotated in the first direction or the second direction, the piston assembly 520 still pushes via the switching element to either the first edge 509 or the second edge 510 of the partially toothed U-recessed element 508. When, subsequently, the luggage item is tilted into its further tilted position, the front wheels 142' are free to move and the force that is being applied by the piston assembly 520 to either the first edge 509 or second edge 510 initiates a rotation of the partially toothed U-recessed element 508 around its rotational axis 507 and, consequently, a rotation of the front wheels 142' around the front wheel rotational axis 150. This mechanism is further illustrated in the subsequent figures.

Figure 6:
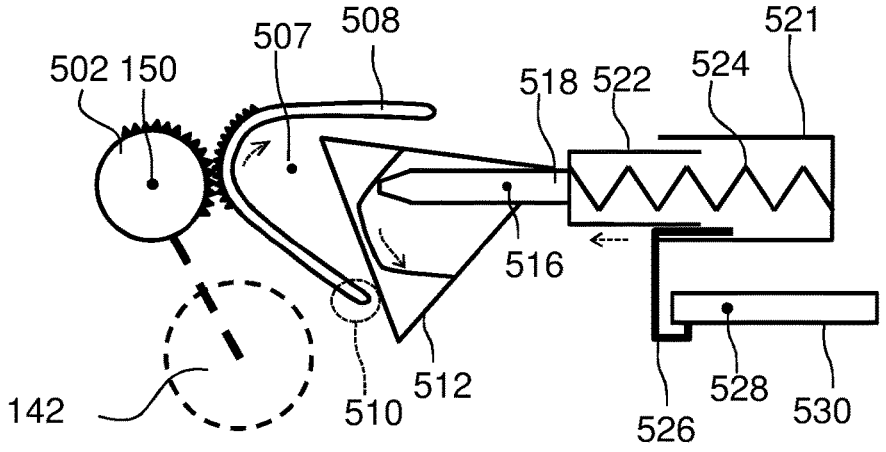

FIG. 6 schematically shows a cross-sectional view of the portion 500 of the wheel assembly wherein the front wheels 142 are rotated to their folded position. What is shown in FIG. 6 is that the pedal 530 is released, that the piston moved into a direction towards the partially toothed U-recessed element 508, that the switching element 512 pushed against the second edge 510 of the partially toothed U-recessed element 508, that the switching element 512 is partially rotated in the second direction, and, that, subsequently, when the luggage item was tilted into the further tilted position, resulted in a rotation of the front wheels 142 towards the folded position.

Figure 7:
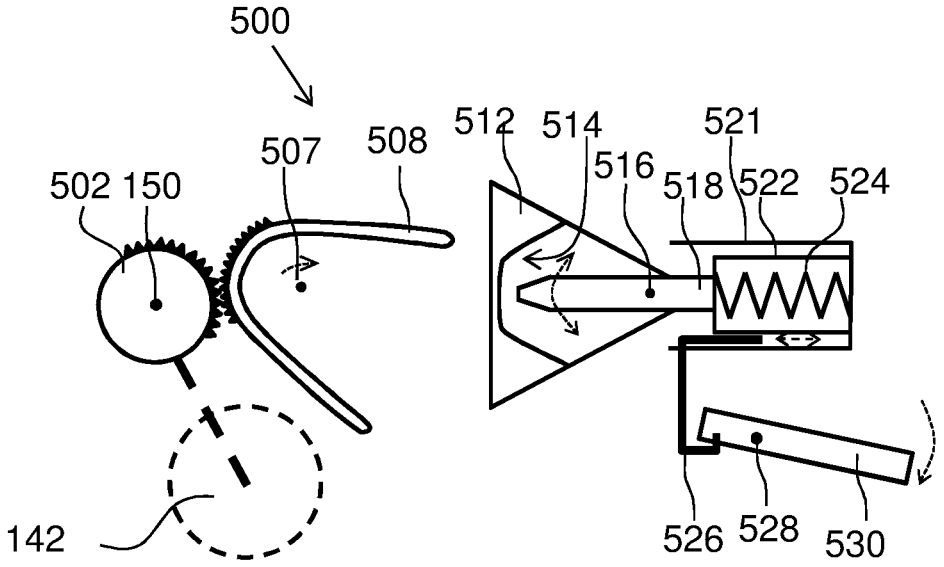

FIG. 7 schematically shows a cross-sectional view of the portion 500 of the wheel assembly wherein the front wheels 142 are still at their folded position and the pedal 530 is operated by a user. When the user pushes on the pedal 530, the piston 522 is pushed by the coupling 526 as far as possible into the cylinder 512 such that energy is stored in the spring 524. When the position moves away from the partially toothed U-recessed element 508, the switching element 512 rotates back to its neutral position.

Figure 8:
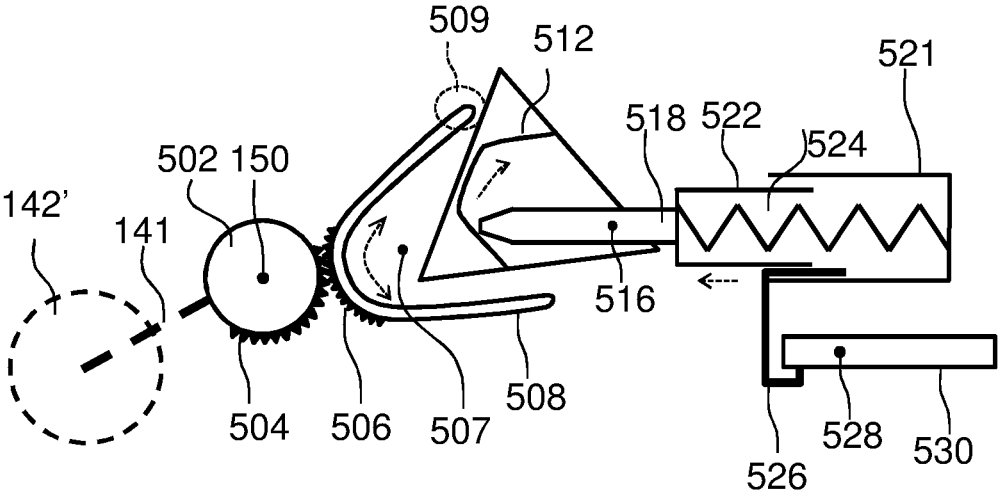

FIG. 8 schematically shows a cross-sectional view of the portion 500 of the wheel assembly wherein the front wheels 142' are rotated to their unfolded position. As discussed above, when the user releases the pedal 530, the pedal moves back to its neutral position. At the same time the spring 524 pushes the piston 522 once again towards the partially toothed U-recessed element 508, but (which is different from the above discussion of FIG. 6) the switching element 512 now touches the first edge 509 of the partially toothed U-recessed element 508 and the switching element 512 rotates at least partially into the first direction. Subsequently, when the user tilts the luggage item into its further tilted direction, the front wheel 142' are free to move and the force applied by the switching element 512 against the first edge 509 forces the partially toothed U-recessed element 508 to rotate and thereby the front wheels 142' are moved into their unfolded position as shown.

The above described mechanism of moving the front wheels 142 from their folded position to their unfolded position may be combined with one or more locking mechanisms for locking the front wheels 142 at their folded and/or their unfolded position. The locking mechanism may, for example, also be coupled to the pedal 530 and when the pedal is operated, the front wheels 142 are releases such that a movement from the folded position to the unfolded position (and vice versa) is possible.

The above described pedal 530 may be provided at the rear side of the luggage assembly such that it can be conveniently operated by a user of the luggage assembly. In an embodiment, the pedal 530 can only be operated when the rear wheels are in their unfolded position to prevent that the pedal 530 is accidentally operated and the front wheels move to their unfolded position when, for example, the luggage item is transported by a luggage handling system of an airport. In this embodiment, the pedal 530 is arranged directly above the location where the rear wheels are at their unfolded position. In order to operate the pedal 530, it has to move in a downwards direction and when the rear wheels are at their unfolded position, the rear wheels block a possible downwards direction thereby providing a sort of secondary lock of the pedal 530. When the rear wheels are in their unfolded position, the space where the rear wheels are in their folded position is free and provides freedom to the pedal to move in a downward direction. In this embodiment, when a user wants to unfold all wheels of the luggage assembly, the user has first to operate the handle to unfold the rear wheels and subsequently operate the pedal 530 to unfold the front wheel. In this embodiment, when a user want to fold all wheels towards their folded position, the user has first to operate the pedal 530 to move the front wheels towards their folded position, followed by an operation of the handle to move the rear wheels towards their folded position.

It is to be noted that instead of partially toothed element, other types of coupling may be used between the partially toothed wheel 502 and the U-recessed element 508. For example, cables may be provided to couple these elements together. In another embodiment, the U-recessed element 508 is directly coupled to the front wheel support without using intermediate elements.

It is to be noted that the mechanism for moving the front wheels between the folded and the unfolded position, as described above in the context of FIGS. 6 to 8 does not directly depend on the mechanism of moving the rear wheels between their folded and unfolded position and the specific projection of the point of gravity between the front wheels and the rear wheels. Thus, the above discussed embodiment of the mechanism for moving the front wheels between the folded and the unfolded position may be seen as a separate embodiment. However, this mechanism may also be used in the wheel assemblies of the embodiments of FIG. 1 to FIG. 4.

Figure 9:
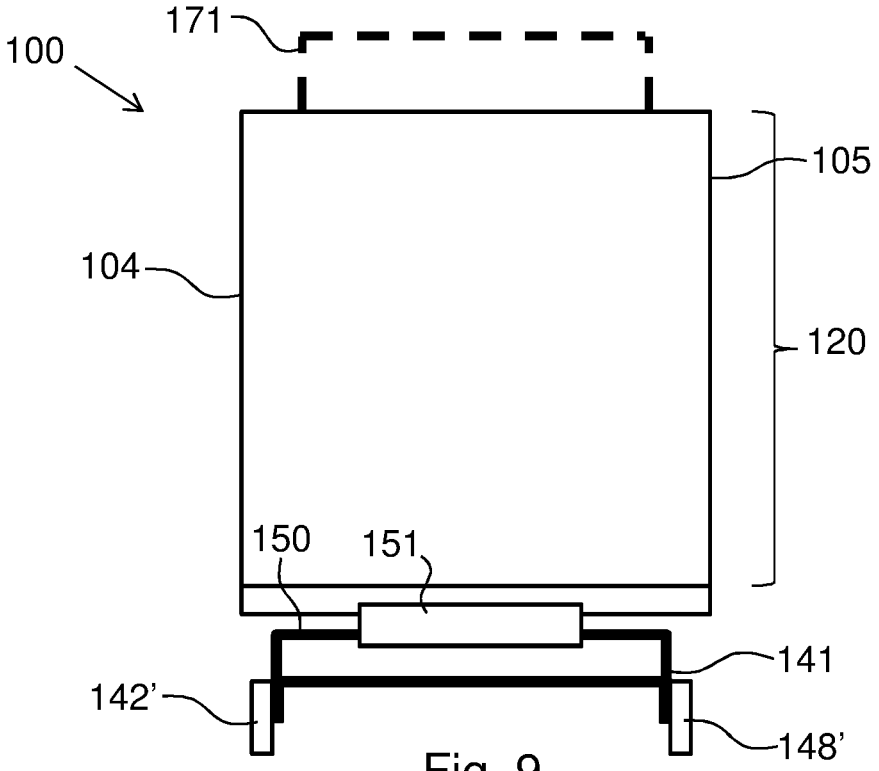

FIG. 9 shows a front view of the luggage item 120 together with parts of the wheel assembly. In FIG. 9 the front wheels 142', 148' are in the unfolded position, also indicated as 142' in FIG. 2. The front wheels 142', 148' are coupled to the front wheel support 141 which is rotatable around axis 150. At axis 150 the front wheel support 141 is coupled to a frame element 151 located under the luggage item 120. In FIG. 9, the bottom of luggage item 120 is visible due to the fact that luggage item is tilted as was explained above with reference to FIGS. 1 and 2.

Figure 10:
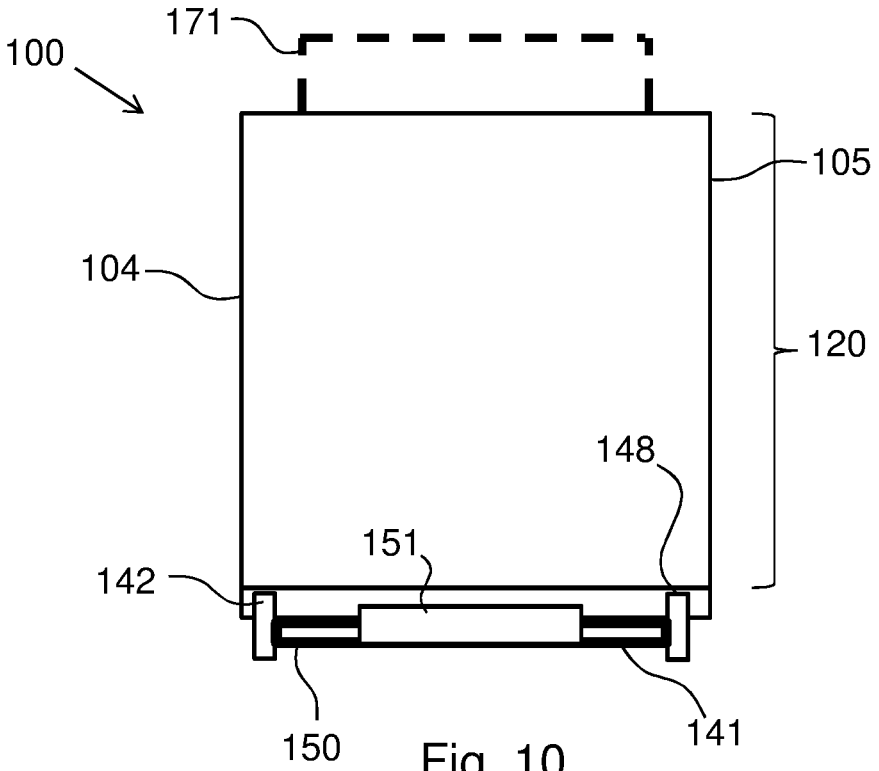

FIG. 10 shows a front view of the luggage item 120 together with parts of the wheel assembly wherein the front wheels 142', 148' are in the folded position, also indicated as 142 in FIG. 2. The front wheels 142', 148' are placed in the folded position by rotating the front wheel support 141 around axis 150 until the front wheels are stored in a space under the luggage item 120, see also trajectory 196 in FIGS. 1 and 2.

Figure 11:
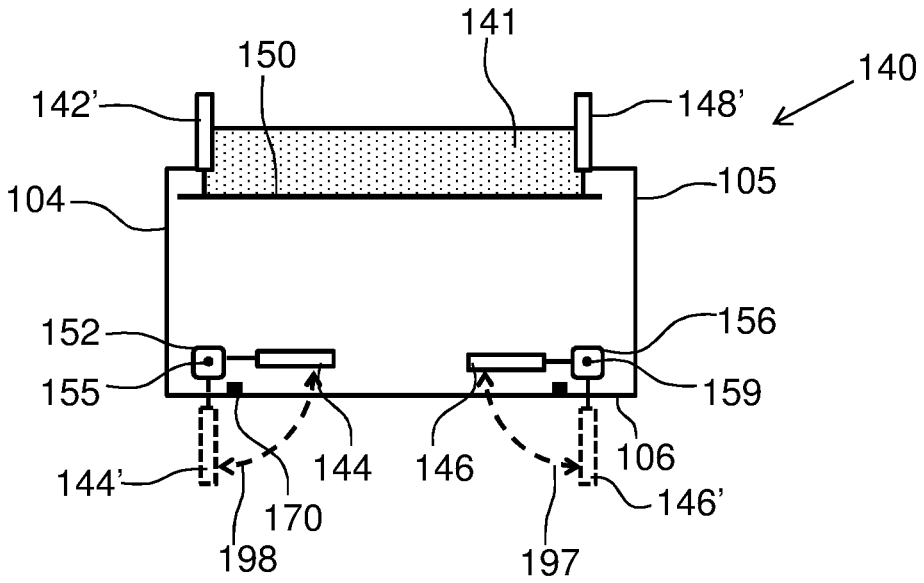

FIG. 11 shows a bottom view of the luggage assembly, wherein the front wheel 142' and 148' are in the unfolded position. Reference is also made to FIG. 4 which shows the same elements, but which shows the front wheel in the folded position.

Figure 12:
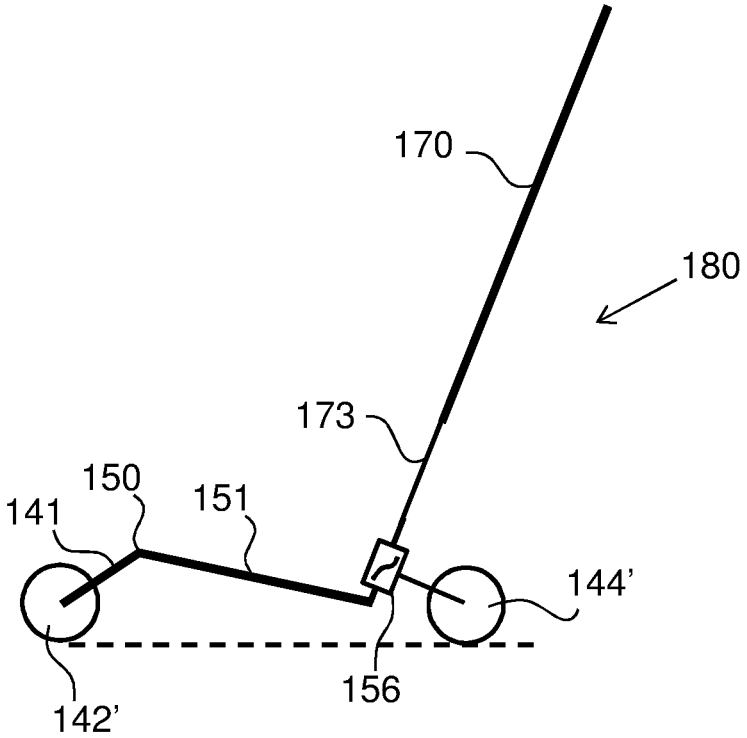

FIG. 12 schematically shows a side view of a frame 180 according to an embodiment. The frame comprises the handle 170, the rear wheels 144' and the front wheels 142'. The frame 180 also comprises the coupling mechanism 173, the helix element 156, the frame element 151 and the front wheel support 141. In FIG. 12, the rear wheels and the front wheels are all in the unfolded position. The frame 180 is in the operational mode, wherein the wheels all touch the ground, indicated by a dashed line.

Examples of the luggage assembly and the frame are defined in the following numbered clauses:

1. A luggage assembly (100) including a luggage item (120) and a wheel assembly (140), the wheel assembly (140) including at least one front wheel (142, 142', 148) and including rear wheels (144, 144', 146, 146') including a first rear wheel (144, 144') and a second rear wheel (146, 146'), the wheels are moveable between a folded position and an unfolded position, wherein,
   - the luggage assembly (100) includes a bottom flank (101) being a surface of the luggage assembly (100) facing, in use, the ground when the luggage assembly (100) is placed on the ground with the wheels (142', 144', 146') in the unfolded position, the bottom flank (101) has a push direction edge and an opposite pull direction edge (114), the push direction edge is facing in a forward direction when, in use, the luggage assembly (100) is pushed by a user, the luggage assembly (100) further includes a rear side (106) being a surface of the luggage assembly (100) coupled to the bottom flank (101) at the pull direction edge (114),
   - the folded position of the wheels (142, 144, 146, 148) is within the luggage assembly (100).
   - the unfolded position of the at least one front wheel (142, 142', 148) is at a specific side of the bottom flank (101) that faces away from the luggage item (120) and is a position closer to the push direction edge than to the pull direction edge (114),
   - the unfolded position of the rear wheels (144', 146') is at a specific side of the rear side (106) that is facing away from the luggage item (120),
   - when the luggage assembly (100) touches the ground with the wheels (142', 144', 146') in the unfolded position and when the luggage item (120) is homogeneously loaded, the luggage item (120) has a tilted position with respect to a line perpendicular to the ground and a projected center of gravity (Pg1*p*, Pg2*p*) of the luggage item (120) is in between the rear wheels (144', 146') and the at least one front wheel (142'), the projected center of gravity (Pg1*p*, Pg2*p*) of the luggage item (120) is a perpendicular projection of a center of gravity (Pg1, Pg2) of the luggage item (120) on the ground.

2. A luggage assembly (100) according to clause 1, wherein the luggage assembly (100) includes a front side (103) being a surface of the luggage assembly (100) coupled to the bottom flank (101) at the push edge, the unfolded position of the at least one front wheel (142') is also at a specific side of the front side (103) that faces away from the luggage item (120).

3. A luggage assembly (100) according to one of the preceding clauses, wherein, when the luggage assembly (100) touches the ground with the wheels (142', 144', 146', 148') in the unfolded position, an x-dimension is defined in a direction from a first line (191) defined by a point where the at least one front wheel (142, 142', 148) touches the ground towards a second line (192) parallel to the first line (191), the second line (192) is defined by points where the rear wheels (144, 144', 146, 146') touch the ground, wherein a position on the first line (191) has an x-coordinate of 0 and a position on the second line (192) has the x-coordinate 1, and when the wheels (142', 144', 146') are in the unfolded position, the projected center of gravity (Pg1*p*, Pg2*p*) has the x-coordinate in a range from 0.2 to 0.9.

4. A luggage assembly (100) according to clause, wherein, when the luggage assembly (100) touches the ground with the wheels (142', 144', 146') in the unfolded position, a tilting angle of the luggage item (120) in the tilted position is within a range from 10 degrees to 35 degrees, the tilting angle is defined between a surface of the luggage item (120) which at least partially coincides with the rear side (106) of the luggage assembly (100) and a line perpendicular to the ground.

5. A luggage assembly (100) according to any one of the clauses 2 to 4, wherein the front side (103) and the rear side (106) of the luggage assembly (100) are separated from each other by flanks, the flanks include the bottom flank (101), a top flank (102), a first side flank (104) and a second side flank (105), the top flank (102) being opposite the bottom flank (101) and the first side flank (104) being opposite the second side flank (105), the first rear wheel (144, 144') is arranged to rotate around a virtual first side rotational axis from the unfolded to the folded position, and vice versa, the virtual first side rotational axis is substantially parallel to and close to an intersectional line of the rear side (106) and the first side flank (104), the second rear wheel (146, 146') is arranged to rotate around a virtual second side rotational axis from the unfolded to the folded position, and vice versa, the virtual second side rotational axis is substantially parallel to and close to an intersectional line of the rear side (106) and the second side flank (105).

6. A luggage assembly (100) according to any one of the preceding clauses, when the luggage assembly includes the top flank (102), further including a handle (170, 171) being assembled to the rear side (106) of the luggage assembly (100), the handle (170, 171) being moveable between a folded position and an unfolded position, the folded position of the handle is within the luggage assembly (100) and the unfolded position is a position at a specific side of the top flank (102) that faces away from the luggage item (120).

7. A luggage assembly (100) according to the combination of clause 5 and 6, wherein the wheel assembly (140) includes a first rear rotator for rotating the first rear wheel (144, 144') around the virtual first side rotational axis and a second rear rotator for rotating the second rear wheel (146, 146') around the virtual second side rotational axis, each one of the rear rotators includes a helix element (152, 156) for transforming a linear movement into a rotational movement, the helix elements (152, 156) include a helix shaped recess (154) for receiving a pin that is coupled to the handle (170, 171) and that is only able to move into a linear direction.

8. A luggage assembly (100) according to any one of the preceding clauses, when referring directly or indirectly to clause 2, wherein the at least one front wheel (142, 142', 148) is arranged to rotate around a virtual front rotational axis from the unfolded to the folded position, and vice versa, the virtual front rotational axis is substantially parallel to an intersectional line of the front side (103) and the bottom flank (101), the virtual front rotational axis is inside the luggage assembly (100) close to the intersectional line of the front side (103) and the bottom flank (101).

9. A luggage assembly (100) according to clause 8, wherein the wheel assembly (140) includes a front wheel support (141) for carrying at least one front wheel (142, 142', 148), the front wheel support (141) includes an arm coupled to an axis (150) coinciding with the virtual front rotational axis, wherein, when the at least one front wheel (142, 142', 148) is in its folded position, the arm extends from the axis (150) in a direction towards the rear side (106) and the at least one front wheel (142, 142', 148) is in between the front side (103) and the rear side (106), wherein the front wheel support (141) is arranged for rotating the at least one front wheel (142, 142', 148) around the axis (150) when the luggage item (120) is arranged in a further tilted position, the rotating of the front wheel support (141) moves the at least one front wheel (142, 142', 148) along a trajectory from unfolded position towards another position below the bottom flank (101) to its unfolded position, or vice versa, in the further tilted position the luggage item (120) is more tilted than in the tilted position of the luggage item (120).

10. A luggage assembly (100) according to any one of the clauses 8 or 9, wherein the wheel assembly (140) includes a pedal (530) and a piston assembly (520), the piston assembly (520) includes a moveable piston (522) and a resilient element (524) for pressing the moveable piston (522) towards an extended position, the pedal (530) is coupled to the piston assembly for compressing the resilient element (524) in response to an operation of the pedal (530) by a user, the piston assembly (520) being arranged for storing energy in the resilient element (524) for rotating the at least one front wheel (142, 142', 148) when the luggage item (120) is in the further tilted position.

11. A luggage assembly (100) according to clause 10, wherein the wheel assembly (140) also includes an U-recessed element (508) and the piston assembly (520) includes a switching element (512), the U-recessed element (508) is arranged rotatable around and axis (507) and is coupled to the at least one front wheel (142, 142', 148) for rotating the at least one front wheel (142, 142', 148) around the virtual front rotational axis when the U-recessed element (508) rotates, the U-recessed element (508) includes a recess which includes a first edge (509) and a second edge (510) at opposite sides of an opening of the recess, the recess is arranged for receiving a portion of the switching element (512), the switching element (512) is coupled to the moveable piston (522), wherein the U-recessed element (508) and the switching element (512) are positioned with respect to each other such that, when energy is stored in the resilient element (524) of the piston assembly (520), the moveable piston (522) pushes the switching element (512) towards the U-recessed element (508) thereby obtaining contact between the switching element (512) and first edge (509) or the second edge (510) of the U-recessed element (508) such that the U-recessed element (508) receives a force in a first direction or in a second direction for obtaining a movement of the at least one front wheel (142, 142', 148) from the folded position to the unfolded position, or vice versa, when the luggage item (120) is arranged in the further tilted position.

12. A luggage assembly (100) according to anyone of the preceding clauses, wherein the luggage item (120) includes a suitcase.

13. A luggage assembly (100) according to one of the preceding clauses further including a handle (170, 171) being assembled to the rear side (106) of the luggage assembly (100), and, when the wheels (142', 144', 146') are in the unfolded position and the luggage assembly (100) touches the ground with the wheels (142', 144', 146'), the luggage assembly (100) is suitable for being pushed and pulled by a user, and, when at least the rear wheels (144', 146') are in their unfolded position, the luggage assembly (100) is suitable for being pulled by the user.

14. A luggage assembly (100) according to any one of the preceding clauses further including a frame for carrying the luggage item, the frame including the wheel assembly (140) and the luggage item (120) being releasable attached to the frame.

15. A frame for carrying a luggage item (120), the frame including a wheel assembly (140) as defined in any one of the clauses 1 to 14.

In summary, this application provides a luggage assembly and a frame. The luggage assembly includes a luggage item and a wheel assembly. The wheel assembly includes front wheels and rear wheels which are all moveable between a folded and an unfolded position. The folded positions of the wheels are within the luggage assembly. The unfolded position of the rear wheels is behind the luggage assembly and the unfolded position of the front wheels is below the luggage assembly. When the wheels are in the unfolded position and the luggage assembly is arranged on the wheels on the ground, the luggage item is tilted and a projected point of gravity of the luggage item is in between the wheels. The luggage assembly is suitable for being pushed and being pulled, is very stable and provides a stable road behavior.

It should be noted that the above-mentioned embodiments illustrate rather than limit the presently disclosed subject matter, and that those of ordinary skill in the art will be able to design many alternative embodiments.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. Some embodiments may be implemented by hardware including several distinct elements, and by a suitably programmed computer. In the device claim enumerating several ways, several of which may be embodied by one and the same item of hardware. The mere fact that certain measures are recited in mutually different dependent claims does not indicate that a combination of these measures cannot be used to advantage.

The invention claimed is:

1. A luggage assembly that is movable along a ground surface, comprising:

a luggage item;

a wheel assembly, the wheel assembly including front wheels, and rear wheels, the front wheels including a first front wheel, and a second front wheel, the rear wheels including a first rear wheel, and a second rear wheel, the front and rear wheels being moveable between a folded position and an unfolded position;

a bottom flank that defines a surface facing, in use, the ground surface when the luggage assembly is placed on the ground surface with the front and rear wheels in an unfolded position, the bottom flank having a push direction edge, and an opposite pull direction edge, the push direction edge facing in a forward direction when, in use, the luggage assembly is pushed by a user;

a rear side that defines a surface coupled to the bottom flank at the pull direction edge, a front side that defines a surface coupled to the bottom flank at the push edge, wherein:

the folded position of the front and rear wheels is within the luggage assembly, the unfolded position of the front wheels is completely at a side of the bottom flank that faces away from the luggage item, and is positioned closer to the push direction edge than to the pull direction edge, the unfolded position of the rear wheels is completely at a side of the rear side that is facing away from the luggage item, and when the luggage assembly touches the ground surface with the front and rear wheels in the unfolded position, the luggage item, when seen from aside, has a tilted position with respect to a line perpendicular to the ground surface in which the rear side tilts towards the ground surface, and has a projected center of the luggage item which, when seen from aside, is in between the rear wheels, and the front wheels, the projected center of the luggage item being defined as a perpendicular projection of a center of the luggage item on the ground surface, wherein the front wheels are arranged to rotate around a front rotational axis from the unfolded to the folded position, and from the folded position to the unfolded position, the front rotational axis is parallel to an intersectional line of the front side, and the bottom flank, the front rotational axis is inside the luggage assembly within a distance of ten centimeters from the intersectional line of the front side, and the bottom flank, wherein the wheel assembly includes a front wheel support for providing support to the front wheels, the front wheel support further including an arm coupled to an axis coinciding with the front rotational axis, wherein:

when the front wheels are in the folded position, the arm extends from the axis in a direction towards the rear side, and the front wheels are in between the front side, and the rear side, wherein the front wheel support is rotatable around the axis when the luggage item is arranged in a further tilted position, the rotating of the front wheel support moves each of the front wheels along a trajectory from the unfolded position towards another position below the bottom flank to the folded position, or from the folded position below the bottom flank towards the unfolded position, wherein in the further tilted position the luggage item is more tilted than in the tilted position of the luggage item, and the rear side is closed to the ground surface than in the tilted position.

2. The luggage assembly according to claim 1, wherein: the unfolded position of the front wheels is also completely at a side of the front side that faces away from the luggage item.

3. The luggage assembly according to claim 1, wherein: when the front and rear wheels in the unfolded position, and when looking to the luggage assembly from aside:

an x-dimension is defined in a direction from a first line defined by a point where the front wheels touch the ground surface towards a second line parallel to the first line; and the second line is defined by points where the rear wheels touch the ground surface, wherein a position on the first line has an x-coordinate of 0 and a position on the second line has the x-coordinate 1, and when the front and rear wheels are in the unfolded position, the projected center of the luggage item has the x-coordinate in a range from 0.2 to 0.9.

4. The luggage assembly according to claim 1, wherein: when the luggage assembly touches the ground surface with the front and rear wheels in the unfolded position, a tilting angle of the luggage item in the tilted position is within a range from 10 degrees to 35 degrees, the tilting angle is defined between a surface of the luggage item which at least partially coincides with the rear side of the luggage assembly, and a line perpendicular to the ground surface.

5. The luggage assembly according to claim 2, wherein: the front side and the rear side of the luggage assembly are separated from each other by flanks, the flanks include the bottom flank, a top flank, a first side flank, and a second side flank, the top flank being opposite the bottom flank, and the first side flank being opposite the second side flank, the first rear wheel is arranged to rotate around a first side rotational axis from the unfolded to the folded position, and from the folded position to the unfolded position, the first side rotational axis is parallel to, and within a distance of ten centimeters from an intersectional line of the rear side, and the first side flank, the second rear wheel is arranged to rotate around a second side rotational axis from the unfolded to the folded position, and from the folded position to the unfolded position, the second side rotational axis is parallel to and within a distance of ten centimeters from an intersectional line of the rear side, and the second side flank.

6. The luggage assembly according to claim 5, wherein: when the luggage assembly includes the top flank, the luggage assembly further includes a handle assembled to the rear side of the luggage assembly, the handle is moveable between a folded position and an unfolded position, the folded position of the handle is within the luggage assembly, and the unfolded position is a position at a specific side of the top flank that faces away from the luggage item.

7. The luggage assembly according to claim 6, wherein the wheel assembly comprises:

a first rear rotator for rotating the first rear wheel around the first side rotational axis and a second rear rotator for rotating the second rear wheel around the second side rotational axis, each one of said rear rotators comprises a helix element for transforming a linear movement into a rotational movement, said helix elements comprise a helix shaped recess for receiving a pin that is coupled to the handle and that is only able to move into a linear direction.

8. The luggage assembly according to claim 1, wherein: the wheel assembly includes a pedal, and a piston assembly, the piston assembly includes a moveable piston, and a resilient element for pressing the moveable piston towards an extended position, the pedal is coupled to the piston assembly for compressing the resilient element in response to an operation of the pedal by a user, the piston assembly configured for storing energy in the resilient element for rotating the first and second front wheel when the luggage item is in the further tilted position.

9. The luggage assembly according to claim 8, wherein: the wheel assembly further includes an U-recessed element, and the piston assembly comprises a switching element, the U-recessed element is arranged rotatable around and axis, and is coupled to the front wheels for rotating the front wheels around the front rotational axis when the U-recessed element rotates, the U-recessed element comprises a recess which comprises a first edge, and a second edge at opposite sides of an opening of the recess, the recess is arranged for receiving a portion of the switching element, the switching element is coupled to the moveable piston, wherein the U-recessed element and the switching element are positioned with respect to each other such that, when energy is stored in the resilient element of the piston assembly, the moveable piston pushes the switching element towards the U-recessed element thereby obtaining contact between the switching element and first edge, or the second edge of the U-recessed element such that the U-recessed element receives a force in a first direction or in a second direction for obtaining a movement of the front wheels from the folded position to said unfolded position, or from the unfolded position to the folded position, when the luggage item is arranged in the further tilted position.

10. The luggage assembly according to claim 1, wherein the luggage item comprises a suitcase.

11. The luggage assembly according to claim 1, further comprising:

a handle being assembled to the rear side of the luggage assembly, and, when the wheels are in the unfolded position and the luggage assembly touches the ground surface with the wheels, the luggage assembly is suitable for being pushed and pulled by a user, and, when at least the rear wheels are in the unfolded position, the luggage assembly is suitable for being pulled by the user.

12. The luggage assembly according to claim 1, further comprising:

a frame for carrying the luggage item, the frame comprising the wheel assembly, and the luggage item being releasably attached to the frame.

13. A frame that is movable along a ground surface, wherein the frame is for use with a luggage assembly and carrying a luggage item, the luggage assembly including a bottom flank, a front side and a rear side, the frame comprising:

a wheel assembly that includes front wheels, and rear wheels, the front wheels including a first front wheel, and a second front wheel, the rear wheels including a first rear wheel, and a second rear wheel, the front and rear wheels being moveable between a folded position and an unfolded position; wherein:

the bottom flank defines a surface facing, in use, the ground surface when the luggage assembly is placed on the ground surface with the wheels in the unfolded position, the bottom flank having a push direction edge, and an opposite pull direction edge, the push direction edge facing in a forward direction when, in use, the luggage assembly is pushed by a user; and the rear side defines a surface coupled to the bottom flank at the pull direction edge, such that:

the folded position of the wheels is within the luggage assembly, the unfolded position of the front wheels are completely at a side of the bottom flank that faces away from the luggage item, and is positioned closer to the push direction edge than to the pull direction edge, the unfolded position of the rear wheels is completely at a side of the rear side that is facing away from the luggage item, and when the luggage assembly touches the ground surface with the wheels in the unfolded position and, the luggage item has a tilted position with respect to a line perpendicular to the ground surface in which the rear side tilts towards the ground surface and has a projected center of the luggage item is in between the rear wheels, and the front wheels, the projected center of the luggage item is a perpendicular projection of a center of the luggage item on the ground surface, wherein the front wheels are arranged to rotate around a front rotational axis from the unfolded to the folded position, and from the folded position to the unfolded position, the front rotational axis is parallel to an intersectional line of the front side, and the bottom flank, the front rotational axis is inside the luggage assembly within a distance of ten centimeters from the intersectional line of the front side, and the bottom flank, wherein the wheel assembly includes a front wheel support for providing support to the front wheels, the front wheel support further including an arm coupled to an axis coinciding with the front rotational axis, wherein:

when the front wheels are in the folded position, the arm extends from the axis in a direction towards the rear side, and the front wheels are in between the front side, and the rear side, wherein the front wheel support is rotatable around the axis when the luggage item is arranged in a further tilted position, the rotating of the front wheel support moves each of the front wheels along a trajectory from the unfolded position towards another position below the bottom flank to the folded position, or from the folded position below the bottom flank towards the unfolded position, wherein in the further tilted position the luggage item is more tilted than in the tilted position of the luggage item, and the rear side is closed to the ground surface than in the tilted position.

* * * * *